US008717181B2

(12) United States Patent
Tallent et al.

(10) Patent No.: US 8,717,181 B2
(45) Date of Patent: May 6, 2014

(54) BED EXIT ALERT SILENCE WITH AUTOMATIC RE-ENABLE

(75) Inventors: Dan R. Tallent, Hope, IN (US); Michelle Kovach, Cincinnati, OH (US); James M. Allen, Batesville, IN (US); Timothy A. Stanley, Indianapolis, IN (US); Aziz A. Bhai, West Chester, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 276 days.

(21) Appl. No.: 13/017,267

(22) Filed: Jan. 31, 2011

(65) Prior Publication Data

US 2012/0025992 A1 Feb. 2, 2012

Related U.S. Application Data

(63) Continuation-in-part of application No. 12/845,870, filed on Jul. 29, 2010.

(51) Int. Cl.
*G08B 21/22* (2006.01)

(52) U.S. Cl.
USPC ..... 340/573.4; 5/940; 340/666

(58) Field of Classification Search
USPC ..... 5/600, 613–620, 732, 940; 177/45, 145; 340/573.1, 573.4, 573.7, 575, 340/665–667, 691.1, 691.3, 6.1, 8.1
See application file for complete search history.

(56) References Cited

U.S. PATENT DOCUMENTS

| | | | |
|---|---|---|---|
| 299,649 | A | 6/1884 | Keep et al. |
| 1,758,546 | A | 5/1930 | Wartmann |
| 1,969,554 | A | 8/1934 | Gloudemans |
| 2,249,645 | A | 7/1941 | Applegarth, Sr. |
| 2,260,715 | A | 10/1941 | Ketchem |
| 2,425,790 | A | 8/1947 | Fletcher |
| 2,430,702 | A | 11/1947 | Bohannan |
| 2,644,332 | A | 7/1953 | Ulrich |
| 2,735,291 | A | 2/1956 | Quinn |
| 2,780,693 | A | 2/1957 | McClellan |
| 2,784,395 | A | 3/1957 | Gorby |
| 2,818,477 | A | 12/1957 | Gollhofer |
| 2,819,612 | A | 1/1958 | Borgstrom et al. |
| 2,990,899 | A | 7/1961 | De Bella |
| 3,096,061 | A | 7/1963 | Bertell |

(Continued)

FOREIGN PATENT DOCUMENTS

| | | |
|---|---|---|
| DE | 44 29 306 A1 | 2/1996 |
| DE | 100 01 921 A1 | 7/2001 |

(Continued)

*Primary Examiner* — Benjamin C Lee
*Assistant Examiner* — Stephen Burgdorf
(74) *Attorney, Agent, or Firm* — Barnes & Thornburg LLP

(57) ABSTRACT

A hospital bed has a bed exit alarm system including an audible alarm that sounds when an alert condition is detected, such as when a patient exits the bed or moves toward exiting the bed. The bed exit alarm system includes at least one user input that is used to enable the bed exit alarm system and a bed exit alarm silence input that stops the audible alarm from sounding or that prevents the alarm from sounding. The bed exit alarm system is configured such that after the bed exit alarm silence input is used, the bed exit alarm system is re-enabled automatically without any action by a caregiver in response to one or more sensors sensing that the patient is, once again, supported on the bed.

20 Claims, 10 Drawing Sheets

(56) References Cited

U.S. PATENT DOCUMENTS

| | | | |
|---|---|---|---|
| 3,217,818 | A | 11/1965 | Engelsher et al. |
| 3,325,799 | A | 6/1967 | Farris |
| 3,338,323 | A | 8/1967 | Swersey |
| 3,360,062 | A | 12/1967 | Potter |
| 3,418,847 | A | 12/1968 | Nantz |
| 3,439,358 | A | 4/1969 | Salmons |
| 3,492,865 | A | 2/1970 | Johnson |
| 3,504,540 | A | 4/1970 | Pradko et al. |
| 3,512,595 | A | 5/1970 | Laimins |
| 3,533,095 | A | 10/1970 | Collins |
| 3,589,457 | A | 6/1971 | Joos |
| 3,656,478 | A | 4/1972 | Swersey |
| 3,712,294 | A | 1/1973 | Muller |
| 3,722,611 | A | 3/1973 | Tirkkonen |
| 3,741,328 | A | 6/1973 | Andersson et al. |
| 3,760,794 | A | 9/1973 | Basham |
| 3,766,344 | A | 10/1973 | Nevett |
| 3,773,124 | A | 11/1973 | Bullivant |
| 3,781,843 | A | 12/1973 | Harrison et al. |
| 3,795,284 | A | 3/1974 | Mracek et al. |
| 3,796,208 | A | 3/1974 | Bloice |
| 3,826,145 | A | 7/1974 | McFarland |
| 3,836,900 | A | 9/1974 | Mansfield |
| 3,852,736 | A | 12/1974 | Cook et al. |
| 3,876,018 | A | 4/1975 | Mracek et al. |
| 3,890,958 | A | 6/1975 | Fister et al. |
| RE28,754 | E | 3/1976 | Cook et al. |
| 3,961,201 | A | 6/1976 | Rosenthal |
| 3,961,627 | A | 6/1976 | Ernst et al. |
| 3,961,675 | A | 6/1976 | Siegel |
| 3,972,320 | A | 8/1976 | Kalman |
| 3,974,491 | A | 8/1976 | Sipe |
| 3,988,790 | A | 11/1976 | Mracek et al. |
| 3,991,414 | A | 11/1976 | Moran |
| 3,991,415 | A | 11/1976 | Baar, Sr. |
| 3,991,746 | A | 11/1976 | Hanna |
| 4,006,789 | A | 2/1977 | Stultz et al. |
| 4,015,677 | A | 4/1977 | Silva et al. |
| 4,020,482 | A | 4/1977 | Feldl |
| 4,023,633 | A | 5/1977 | Swersey et al. |
| 4,033,420 | A | 7/1977 | De Masters |
| 4,067,005 | A | 1/1978 | Levy et al. |
| 4,129,189 | A | 12/1978 | Maglecic et al. |
| 4,140,998 | A | 2/1979 | Bettle |
| 4,150,326 | A | 4/1979 | Engelberger et al. |
| 4,175,263 | A | 11/1979 | Triplett et al. |
| 4,179,692 | A | 12/1979 | Vance |
| 4,180,803 | A | 12/1979 | Wesemeyer et al. |
| 4,188,621 | A | 2/1980 | Heckelman et al. |
| 4,195,287 | A | 3/1980 | McCoy et al. |
| 4,196,425 | A | 4/1980 | Williams, Jr. et al. |
| 4,199,792 | A | 4/1980 | Satoh et al. |
| 4,228,426 | A | 10/1980 | Roberts |
| 4,231,030 | A | 10/1980 | Weiss |
| 4,242,672 | A | 12/1980 | Gault |
| 4,245,651 | A | 1/1981 | Frost |
| 4,257,035 | A | 3/1981 | Yen |
| 4,263,586 | A | 4/1981 | Nicholas |
| 4,264,904 | A | 4/1981 | McCoy et al. |
| 4,281,730 | A | 8/1981 | Swersey et al. |
| 4,282,412 | A | 8/1981 | Florin |
| 4,290,136 | A | 9/1981 | Brunner et al. |
| 4,295,133 | A | 10/1981 | Vance |
| 4,298,863 | A | 11/1981 | Natitus et al. |
| 4,320,766 | A | 3/1982 | Alihanka et al. |
| 4,323,064 | A | 4/1982 | Hoenig et al. |
| 4,335,468 | A | 6/1982 | Foster et al. |
| 4,336,533 | A | 6/1982 | Wettach |
| 4,337,726 | A | 7/1982 | Czekajewski et al. |
| 4,346,771 | A | 8/1982 | Persson et al. |
| 4,348,562 | A | 9/1982 | Florin |
| 4,350,860 | A | 9/1982 | Ueda |
| 4,363,368 | A | 12/1982 | Paddon et al. |
| 4,411,327 | A | 10/1983 | Lockery et al. |
| 4,419,830 | A | 12/1983 | Miller |
| 4,420,052 | A | 12/1983 | Hale |
| 4,426,644 | A | 1/1984 | Neumann et al. |
| 4,426,884 | A | 1/1984 | Polchaninoff |
| 4,438,823 | A | 3/1984 | Hussels et al. |
| 4,474,185 | A | 10/1984 | Diamond |
| 4,475,013 | A | 10/1984 | Lee et al. |
| 4,482,783 | A | 11/1984 | Laimins |
| 4,483,404 | A | 11/1984 | Weihs |
| 4,484,043 | A | 11/1984 | Musick et al. |
| 4,487,276 | A | 12/1984 | Swersey et al. |
| 4,492,281 | A | 1/1985 | Van Allen et al. |
| 4,519,027 | A | 5/1985 | Vogelsberg |
| 4,526,043 | A | 7/1985 | Boie et al. |
| 4,536,755 | A | 8/1985 | Holzgang et al. |
| 4,539,560 | A | 9/1985 | Fleck et al. |
| 4,540,057 | A | 9/1985 | Freeman |
| 4,550,793 | A | 11/1985 | Giles |
| 4,551,029 | A | 11/1985 | Aizawa |
| 4,551,882 | A | 11/1985 | Swersey et al. |
| 4,558,181 | A | 12/1985 | Blanchard et al. |
| 4,565,910 | A | 1/1986 | Musick et al. |
| 4,572,006 | A | 2/1986 | Wolfendale |
| 4,573,475 | A | 3/1986 | Dukes et al. |
| 4,577,185 | A | 3/1986 | Andersen |
| 4,577,709 | A | 3/1986 | Shibahara et al. |
| 4,583,084 | A | 4/1986 | Henderson et al. |
| 4,584,989 | A | 4/1986 | Stith |
| 4,587,739 | A | 5/1986 | Holcomb et al. |
| 4,597,487 | A | 7/1986 | Crosby et al. |
| 4,600,066 | A | 7/1986 | Griffen et al. |
| 4,601,356 | A | 7/1986 | Muccillo, Jr. |
| 4,629,015 | A | 12/1986 | Fried et al. |
| 4,633,237 | A | 12/1986 | Tucknott et al. |
| 4,638,307 | A | 1/1987 | Swartout |
| 4,638,876 | A | 1/1987 | Balduin et al. |
| 4,649,759 | A | 3/1987 | Lee |
| 4,659,233 | A | 4/1987 | Nakamura et al. |
| 4,670,864 | A | 6/1987 | Hoffmann |
| 4,679,144 | A | 7/1987 | Cox et al. |
| 4,696,358 | A | 9/1987 | Doerman et al. |
| 4,700,180 | A | 10/1987 | Vance |
| 4,738,325 | A | 4/1988 | Bullivant et al. |
| 4,751,754 | A | 6/1988 | Bailey et al. |
| 4,757,867 | A | 7/1988 | Rosenthal et al. |
| 4,777,944 | A | 10/1988 | Green et al. |
| 4,793,428 | A | 12/1988 | Swersey |
| 4,796,013 | A | 1/1989 | Yasuda et al. |
| 4,801,979 | A | 1/1989 | Bourgeois |
| 4,803,744 | A | 2/1989 | Peck et al. |
| 4,804,052 | A | 2/1989 | Griffen |
| 4,805,637 | A | 2/1989 | Walthert |
| 4,807,558 | A | 2/1989 | Swersey |
| 4,827,763 | A | 5/1989 | Bourland et al. |
| 4,839,512 | A | 6/1989 | Speck |
| 4,845,323 | A | 7/1989 | Beggs |
| 4,858,622 | A | 8/1989 | Osterweil |
| 4,865,581 | A | 9/1989 | Lundquist et al. |
| 4,866,356 | A | 9/1989 | Altendorf |
| 4,866,417 | A | 9/1989 | DeFino et al. |
| 4,887,086 | A | 12/1989 | Unser et al. |
| 4,899,840 | A | 2/1990 | Boubille |
| 4,907,845 | A | 3/1990 | Wood |
| 4,911,372 | A | 3/1990 | Uchida et al. |
| 4,926,951 | A | 5/1990 | Carruth et al. |
| 4,934,468 | A | 6/1990 | Koerber, Sr. et al. |
| 4,934,768 | A | 6/1990 | Blaisdell |
| 4,947,152 | A | 8/1990 | Hodges |
| 4,947,298 | A | 8/1990 | Stephen |
| 4,951,032 | A | 8/1990 | Langsam |
| 4,953,244 | A | 9/1990 | Koerber, Sr. et al. |
| 4,953,277 | A | 9/1990 | Crispin et al. |
| 4,955,947 | A | 9/1990 | Hajianpour |
| 4,961,470 | A | 10/1990 | Koerber, Sr. |
| 4,967,384 | A | 10/1990 | Molinar et al. |
| 4,972,177 | A | 11/1990 | Nolan |
| 4,974,692 | A | 12/1990 | Carruth et al. |
| 4,999,719 | A | 3/1991 | Tozaki et al. |
| 5,007,420 | A | 4/1991 | Bird |
| 5,008,654 | A | 4/1991 | Callaway |

(56) References Cited

U.S. PATENT DOCUMENTS

| | | | |
|---|---|---|---|
| 5,010,772 | A | 4/1991 | Bourland et al. |
| 5,010,774 | A | 4/1991 | Kikuo et al. |
| 5,019,905 | A | 5/1991 | Pshtissky et al. |
| 5,033,563 | A | 7/1991 | Brainerd, Jr. et al. |
| 5,060,174 | A | 10/1991 | Gross |
| 5,081,406 | A | 1/1992 | Hughes et al. |
| 5,107,845 | A | 4/1992 | Guern et al. |
| 5,140,309 | A | 8/1992 | Gusakov |
| 5,144,284 | A | 9/1992 | Hammett |
| 5,150,104 | A | 9/1992 | Thomas et al. |
| 5,165,397 | A | 11/1992 | Arp |
| 5,166,679 | A | 11/1992 | Vranish et al. |
| 5,167,660 | A | 12/1992 | Altendorf |
| 5,170,364 | A | 12/1992 | Gross et al. |
| 5,173,977 | A | 12/1992 | Carruth et al. |
| 5,183,126 | A | 2/1993 | Kellenbach |
| 5,184,112 | A | 2/1993 | Gusakov |
| 5,209,126 | A | 5/1993 | Grahn |
| 5,224,561 | A | 7/1993 | Ahl |
| 5,232,064 | A | 8/1993 | Kroll et al. |
| 5,235,319 | A | 8/1993 | Hill et al. |
| 5,250,801 | A | 10/1993 | Grozinger et al. |
| 5,253,656 | A | 10/1993 | Rincoe et al. |
| 5,268,670 | A | 12/1993 | Brasch et al. |
| 5,269,388 | A | 12/1993 | Reichow et al. |
| 5,276,430 | A | 1/1994 | Granovsky |
| 5,276,432 | A | 1/1994 | Travis |
| 5,279,010 | A | 1/1994 | Ferrand et al. |
| 5,283,816 | A | 2/1994 | Gomez Diaz |
| 5,319,355 | A | 6/1994 | Russek |
| 5,319,817 | A | 6/1994 | Hay et al. |
| 5,339,392 | A | 8/1994 | Risberg et al. |
| 5,345,809 | A | 9/1994 | Corrigan et al. |
| 5,349,430 | A | 9/1994 | Yamamoto et al. |
| 5,353,012 | A | 10/1994 | Barham et al. |
| 5,393,935 | A | 2/1995 | Hasty et al. |
| 5,393,938 | A | 2/1995 | Bumbalough |
| 5,402,426 | A | 3/1995 | Foglar et al. |
| 5,410,297 | A | 4/1995 | Joseph et al. |
| 5,424,711 | A | 6/1995 | Muller et al. |
| 5,430,431 | A | 7/1995 | Nelson |
| 5,435,235 | A | 7/1995 | Yoshida |
| D361,462 | S | 8/1995 | Newham |
| 5,446,391 | A | 8/1995 | Aoki et al. |
| 5,448,996 | A | 9/1995 | Bellin et al. |
| 5,459,452 | A | 10/1995 | DePonte |
| 5,469,861 | A | 11/1995 | Piscopo et al. |
| 5,471,198 | A | 11/1995 | Newham |
| 5,473,938 | A | 12/1995 | Handfield et al. |
| 5,479,939 | A | 1/1996 | Ogino |
| 5,493,611 | A | 2/1996 | Hubert |
| 5,494,046 | A | 2/1996 | Cross |
| 5,506,567 | A | 4/1996 | Bichlmaier et al. |
| 5,519,380 | A | 5/1996 | Edwards |
| 5,526,407 | A | 6/1996 | Russell et al. |
| RE35,301 | E | 7/1996 | Reichow |
| 5,553,311 | A | 9/1996 | Mclaughlin et al. |
| 5,554,835 | A | 9/1996 | Newham |
| 5,600,104 | A | 2/1997 | McCauley et al. |
| 5,600,108 | A | 2/1997 | Newham |
| 5,600,305 | A | 2/1997 | Stafford et al. |
| 5,602,734 | A | 2/1997 | Kithil |
| 5,623,760 | A | 4/1997 | Newham |
| 5,633,627 | A | 5/1997 | Newham |
| 5,640,145 | A | 6/1997 | Newham |
| 5,654,694 | A | 8/1997 | Newham |
| 5,664,270 | A | 9/1997 | Bell et al. |
| 5,672,849 | A | 9/1997 | Foster et al. |
| 5,699,038 | A | 12/1997 | Ulrich et al. |
| 5,700,982 | A | 12/1997 | Neuman |
| 5,715,548 | A | 2/1998 | Weismiller et al. |
| 5,717,167 | A | 2/1998 | Filing et al. |
| 5,717,176 | A | 2/1998 | Dahlstrom |
| 5,723,826 | A | 3/1998 | Kitagawa et al. |
| 5,729,197 | A | 3/1998 | Cash |
| 5,732,693 | A | 3/1998 | Bathe et al. |
| 5,747,745 | A | 5/1998 | Neuman |
| 5,760,688 | A | 6/1998 | Kasai |
| 5,767,774 | A | 6/1998 | Wright et al. |
| 5,780,781 | A | 7/1998 | Berger et al. |
| 5,780,798 | A | 7/1998 | Hall-Jackson |
| 5,791,344 | A | 8/1998 | Schulman et al. |
| 5,796,059 | A | 8/1998 | Boon |
| 5,798,487 | A | 8/1998 | Goichman et al. |
| 5,799,317 | A | 8/1998 | He et al. |
| 5,801,339 | A | 9/1998 | Boult |
| 5,801,946 | A | 9/1998 | Nissen et al. |
| 5,802,479 | A | 9/1998 | Kithil et al. |
| 5,802,640 | A | 9/1998 | Ferrand et al. |
| 5,808,552 | A | 9/1998 | Wiley et al. |
| 5,810,392 | A | 9/1998 | Gagnon |
| 5,823,278 | A | 10/1998 | Geringer |
| 5,827,981 | A | 10/1998 | March |
| 5,831,221 | A | 11/1998 | Geringer et al. |
| 5,844,488 | A | 12/1998 | Musick |
| 5,846,206 | A | 12/1998 | Bader |
| 5,859,390 | A | 1/1999 | Stafford et al. |
| 5,861,581 | A | 1/1999 | Evans et al. |
| 5,861,582 | A | 1/1999 | Flanagan et al. |
| 5,864,295 | A | 1/1999 | Jarocha |
| 5,869,788 | A | 2/1999 | Gordon et al. |
| 5,872,594 | A | 2/1999 | Thompson |
| 5,879,309 | A | 3/1999 | Johnson et al. |
| 5,880,410 | A | 3/1999 | Neuman |
| 5,894,269 | A | 4/1999 | Takai et al. |
| 5,896,090 | A | 4/1999 | Okada et al. |
| 5,898,459 | A | 4/1999 | Smith et al. |
| 5,900,814 | A | 5/1999 | Stern |
| 5,906,016 | A | 5/1999 | Ferrand et al. |
| 5,910,647 | A | 6/1999 | Kats et al. |
| 5,933,083 | A | 8/1999 | Sobczynski et al. |
| 5,933,220 | A | 8/1999 | Park |
| 5,933,391 | A | 8/1999 | Uptegraph |
| 5,941,836 | A | 8/1999 | Friedman |
| 5,945,914 | A | 8/1999 | Holmes et al. |
| 5,957,838 | A | 9/1999 | Rantala |
| 5,960,440 | A | 9/1999 | Brenner et al. |
| 5,977,646 | A | 11/1999 | Lenz et al. |
| 5,990,423 | A | 11/1999 | Ashpes et al. |
| 5,990,799 | A | 11/1999 | Boon et al. |
| 5,991,676 | A | 11/1999 | Podoloff et al. |
| 5,999,100 | A | 12/1999 | Wright et al. |
| 6,020,812 | A | 2/2000 | Thompson et al. |
| 6,025,782 | A | 2/2000 | Newham |
| 6,033,370 | A | 3/2000 | Reinbold et al. |
| 6,036,660 | A | 3/2000 | Toms |
| 6,040,532 | A | 3/2000 | Munch |
| 6,049,281 | A | 4/2000 | Osterweil |
| D424,650 | S | 5/2000 | Reichow |
| 6,056,079 | A | 5/2000 | Cech et al. |
| 6,067,019 | A | 5/2000 | Scott |
| 6,075,464 | A | 6/2000 | Cloutier et al. |
| 6,078,253 | A | 6/2000 | Fowler |
| 6,078,261 | A | 6/2000 | Davsko |
| 6,092,478 | A | 7/2000 | Simakrai et al. |
| 6,092,838 | A | 7/2000 | Walker |
| 6,094,762 | A | 8/2000 | Viard et al. |
| 6,111,509 | A | 8/2000 | Holmes |
| 6,133,743 | A | 10/2000 | Gleixner et al. |
| 6,133,837 | A | 10/2000 | Riley |
| 6,147,592 | A | 11/2000 | Ulrich et al. |
| 6,160,493 | A | 12/2000 | Smith |
| 6,166,644 | A | 12/2000 | Stroda |
| 6,167,318 | A | 12/2000 | Kizer et al. |
| D436,322 | S | 1/2001 | Wajer |
| 6,180,893 | B1 | 1/2001 | Salgo |
| 6,204,767 | B1 | 3/2001 | Sparks |
| 6,208,249 | B1 | 3/2001 | Saito et al. |
| 6,208,250 | B1 | 3/2001 | Dixon et al. |
| 6,239,706 | B1 | 5/2001 | Yoshiike et al. |
| 6,252,512 | B1 | 6/2001 | Riley |
| 6,283,719 | B1 | 9/2001 | Frantz et al. |
| 6,297,738 | B1 | 10/2001 | Newham |
| 6,307,476 | B1 | 10/2001 | Smith et al. |

(56) References Cited

U.S. PATENT DOCUMENTS 6,320,510 B2 11/2001 Menkedick et al.
RE37,467 E 12/2001 Brasch et al.
6,331,168 B1 12/2001 Socci et al.
6,359,840 B1 3/2002 Evans
6,362,439 B1 3/2002 Reichow
6,362,725 B1 3/2002 Ulrich et al.
6,396,004 B2 5/2002 Salgo
6,417,777 B2 7/2002 Fitzgerald et al.
6,438,776 B2 8/2002 Ferrand et al.
6,441,742 B1 8/2002 Lovely et al.
6,543,873 B1 4/2003 Van Veen
6,544,200 B1 4/2003 Smith et al.
6,561,017 B1 5/2003 Claussen et al.
6,583,727 B2 6/2003 Nunome
6,615,706 B1 9/2003 Wu
6,636,820 B2 10/2003 Livingston
6,646,556 B1 11/2003 Smith et al.
6,658,465 B1 12/2003 Touboul
6,658,680 B2 12/2003 Osborne et al.
6,667,691 B2 12/2003 Sapir
6,679,899 B2 1/2004 Wiener et al.
6,680,443 B2 1/2004 Dixon
6,727,445 B2 4/2004 Cullinan et al.
6,775,577 B2 8/2004 Crnkovich et al.
6,781,341 B2 8/2004 Nakamichi et al.
6,784,797 B2 8/2004 Smith et al.
6,791,460 B2 9/2004 Dixon et al.
6,795,375 B2 9/2004 Streja
6,819,254 B2 11/2004 Riley
6,821,258 B2 11/2004 Reed et al.
6,822,571 B2 11/2004 Conway
6,845,731 B1 1/2005 Huang
6,847,301 B1 1/2005 Olson
6,864,795 B2 3/2005 Smith et al.
6,865,930 B1 3/2005 Claussen et al.
6,878,910 B2 4/2005 Kim et al.
6,885,298 B2 4/2005 Everson et al.
6,899,691 B2 5/2005 Bainbridge et al.
6,957,461 B2 10/2005 Osborne et al.
6,961,346 B1 11/2005 Michalewicz et al.
7,009,509 B2 3/2006 Sakai
7,030,764 B2 4/2006 Smith et al.
7,034,692 B2 4/2006 Hickle
7,053,765 B1 5/2006 Clark
7,100,439 B2 9/2006 Carlucci
7,113,838 B2 9/2006 Funk et al.
7,117,031 B2 10/2006 Lohman et al.
7,126,065 B2 10/2006 Petrucelli
7,127,293 B2 10/2006 MacDonald
7,169,352 B1 1/2007 Felt et al.
7,175,642 B2 2/2007 Briggs et al.
7,199,700 B1 4/2007 McPherson et al.
7,222,075 B2 5/2007 Petrushin
7,239,387 B2 7/2007 Politze et al.
7,244,262 B2 7/2007 Wiener et al.
7,253,366 B2 8/2007 Bhai
7,256,401 B2 8/2007 Garmer et al.
7,263,635 B2 8/2007 Hentsch
7,283,841 B2 10/2007 Luke et al.
7,296,312 B2 11/2007 Menkedick et al.
7,318,093 B2 1/2008 Touboul
7,319,386 B2 1/2008 Collins, Jr. et al.
7,330,343 B2 2/2008 Chen
7,343,250 B1 3/2008 Nelson et al.
7,344,507 B2 3/2008 Briggs et al.
7,362,704 B2 4/2008 Sisto et al.
7,363,031 B1 4/2008 Aisa
7,379,393 B2 5/2008 Morykwas et al.
7,398,317 B2 7/2008 Chen et al.
7,443,302 B2 10/2008 Reeder et al.
7,459,645 B2 12/2008 Skinner et al.
7,460,837 B2 12/2008 Diener
7,464,605 B2 12/2008 Douglas et al.
7,472,439 B2 1/2009 Lemire et al.
7,477,960 B2 1/2009 Willis et al.
7,513,882 B2 4/2009 Felt et al.
7,519,748 B2 4/2009 Kuzmin
7,538,659 B2 5/2009 Ulrich et al.
7,567,664 B2 7/2009 Hoffman
7,570,152 B2 8/2009 Smith et al.
7,636,365 B2 12/2009 Chang et al.
7,641,854 B2 1/2010 Young
8,413,271 B2 * 4/2013 Blanchard et al. ..... 5/600
8,572,778 B2 * 11/2013 Newkirk et al. ..... 5/600
2001/0001235 A1 5/2001 Menkedick et al.
2001/0001237 A1 5/2001 Stroda et al.
2001/0015292 A1 8/2001 Salgo
2001/0038337 A1 11/2001 Wickstead et al.
2001/0048892 A1 12/2001 Bainbridge et al.
2002/0052616 A1 5/2002 Wiener et al.
2002/0067273 A1 6/2002 Jaques et al.
2002/0070867 A1 6/2002 Conway et al.
2002/0080037 A1 6/2002 Dixon et al.
2002/0103916 A1 8/2002 Chen et al.
2002/0113705 A1 * 8/2002 Wallace ..... 340/568.7
2002/0183017 A1 12/2002 Mujica
2002/0189924 A1 12/2002 Cullinan et al.
2002/0194002 A1 12/2002 Petrushin
2002/0196148 A1 12/2002 Nunome
2003/0018395 A1 1/2003 Crnkovich et al.
2003/0021189 A1 1/2003 Streja
2003/0030448 A1 2/2003 Sapir
2003/0055685 A1 3/2003 Cobb et al.
2003/0063010 A1 4/2003 Smith et al.
2003/0073936 A1 4/2003 Raisanen
2003/0081035 A1 5/2003 Van Veen
2003/0090383 A1 5/2003 Conway
2003/0112140 A1 6/2003 Everson et al.
2003/0114736 A1 6/2003 Reed et al.
2003/0197614 A1 10/2003 Smith et al.
2003/0212424 A1 11/2003 Briggs et al.
2003/0214409 A1 11/2003 Hickle
2003/0216766 A1 11/2003 Wiener et al.
2003/0218443 A1 11/2003 Nakamichi et al.
2004/0032868 A1 2/2004 Oda et al.
2004/0046668 A1 3/2004 Smith et al.
2004/0049219 A1 3/2004 Briggs et al.
2004/0066512 A1 4/2004 Politze et al.
2004/0066709 A1 4/2004 Morykwas et al.
2004/0078714 A1 4/2004 Hentsch
2004/0094542 A1 5/2004 Kim et al.
2004/0095229 A1 5/2004 Chen
2004/0156514 A1 8/2004 Fletcher et al.
2004/0171958 A1 9/2004 Fitts et al.
2004/0215091 A1 10/2004 Lohman et al.
2004/0240546 A1 12/2004 Wells
2005/0001729 A1 1/2005 Garmer et al.
2005/0039742 A1 2/2005 Hickle
2005/0058135 A1 3/2005 Sisto et al.
2005/0065630 A1 3/2005 Funk et al.
2005/0091363 A1 4/2005 McCormick et al.
2005/0128743 A1 6/2005 Chuey et al.
2005/0168341 A1 8/2005 Reeder et al.
2005/0171627 A1 8/2005 Funk et al.
2005/0233777 A1 * 10/2005 Twerdahl ..... 455/567
2005/0254505 A1 11/2005 Chang et al.
2006/0070456 A1 4/2006 Douglas et al.
2006/0103520 A1 5/2006 Clark
2006/0103540 A1 * 5/2006 Rutter et al. ..... 340/628
2006/0111749 A1 5/2006 Westenskow et al.
2006/0152358 A1 7/2006 Osterweil
2006/0158138 A1 7/2006 Walter et al.
2006/0176634 A1 8/2006 Chen
2006/0184264 A1 8/2006 Willis et al.
2006/0250256 A1 11/2006 Power
2006/0277683 A1 12/2006 Lamire et al.
2006/0279426 A1 12/2006 Bonnet et al.
2006/0284978 A1 12/2006 Girgensohn et al.
2006/0286929 A1 12/2006 Schlafly et al.
2007/0004997 A1 1/2007 Felt et al.
2007/0008239 A1 1/2007 Stroupe et al.
2007/0010286 A1 1/2007 Luke et al.
2007/0040649 A1 2/2007 Dulgerian et al.
2007/0040692 A1 2/2007 Smith et al.

(56) References Cited

U.S. PATENT DOCUMENTS

| | | | | |
|---|---|---|---|---|
| 2007/0043585 | A1 | 2/2007 | Matos | |
| 2007/0064516 | A1 | 3/2007 | Briggs et al. | |
| 2007/0073432 | A1 | 3/2007 | Zhang | |
| 2007/0073493 | A1 | 3/2007 | Ognier | |
| 2007/0086754 | A1 | 4/2007 | Lys et al. | |
| 2007/0087842 | A1 | 4/2007 | Huang et al. | |
| 2007/0093774 | A1 | 4/2007 | Felt et al. | |
| 2007/0123173 | A1 | 5/2007 | Stobbe | |
| 2007/0127673 | A1 | 6/2007 | Hoffman | |
| 2007/0136949 | A1* | 6/2007 | Richards et al. | 5/600 |
| 2007/0143490 | A1 | 6/2007 | Gallou et al. | |
| 2007/0156031 | A1* | 7/2007 | Sullivan et al. | 600/300 |
| 2007/0158247 | A1 | 7/2007 | Carr et al. | |
| 2007/0163045 | A1 | 7/2007 | Becker et al. | |
| 2007/0210917 | A1* | 9/2007 | Collins et al. | 340/539.1 |
| 2007/0231223 | A1 | 10/2007 | Young | |
| 2007/0232980 | A1 | 10/2007 | Felt et al. | |
| 2007/0240912 | A1 | 10/2007 | Papazissis | |
| 2007/0249046 | A1 | 10/2007 | Shields, Jr. | |
| 2007/0268147 | A1 | 11/2007 | Bhai | |
| 2007/0272450 | A1 | 11/2007 | Skinner et al. | |
| 2007/0280682 | A1 | 12/2007 | Sichani et al. | |
| 2008/0005428 | A1 | 1/2008 | Maul et al. | |
| 2008/0042856 | A1 | 2/2008 | Power | |
| 2008/0046215 | A1 | 2/2008 | Nelson et al. | |
| 2008/0075368 | A1 | 3/2008 | Kuzmin | |
| 2008/0107924 | A1 | 5/2008 | Wang et al. | |
| 2008/0126122 | A1 | 5/2008 | Warner et al. | |
| 2008/0130422 | A1 | 6/2008 | Hocherman | |
| 2008/0132808 | A1 | 6/2008 | Lokhorst et al. | |
| 2008/0172789 | A1 | 7/2008 | Elliot et al. | |
| 2008/0196419 | A1 | 8/2008 | Dube | |
| 2008/0216504 | A1 | 9/2008 | Kim et al. | |
| 2008/0250138 | A1 | 10/2008 | Harnois et al. | |
| 2008/0268910 | A1 | 10/2008 | Park | |
| 2008/0268920 | A1 | 10/2008 | Billmaier et al. | |
| 2008/0275828 | A1 | 11/2008 | Payton | |
| 2008/0287831 | A1 | 11/2008 | Briggs et al. | |
| 2009/0113335 | A1 | 4/2009 | Sandoe et al. | |
| 2009/0190446 | A1 | 7/2009 | Stuart | |
| 2009/0212925 | A1 | 8/2009 | Schuman, Sr. et al. | |
| 2009/0212956 | A1 | 8/2009 | Schuman et al. | |
| 2009/0217080 | A1 | 8/2009 | Ferguson et al. | |
| 2009/0234908 | A1 | 9/2009 | Reyhner et al. | |
| 2009/0256912 | A1 | 10/2009 | Rosenberg | |
| 2009/0270833 | A1 | 10/2009 | DeBelser et al. | |
| 2009/0275807 | A1 | 11/2009 | Sitzman et al. | |
| 2010/0005137 | A1 | 1/2010 | Kalama et al. | |
| 2010/0026510 | A1* | 2/2010 | Kiani et al. | 340/691.3 |
| 2011/0071420 | A1* | 3/2011 | St. Pierre et al. | 600/549 |
| 2013/0219628 | A1* | 8/2013 | Blanchard et al. | 5/713 |
| 2013/0276237 | A1* | 10/2013 | Bobey et al. | 5/658 |

FOREIGN PATENT DOCUMENTS

| | | | |
|---|---|---|---|
| DE | 201 01 591 | | 7/2001 |
| DE | 10 2005 018 686 | A1 | 11/2006 |
| EP | 0 568 020 | A2 | 11/1993 |
| EP | 0 606 381 | A1 | 7/1994 |
| EP | 0 744 598 | A1 | 11/1996 |
| EP | 0 779 058 | A1 | 6/1997 |
| EP | 0 854 357 | A1 | 7/1998 |
| EP | 0 860 803 | A2 | 8/1998 |
| EP | 1 216 400 | A1 | 6/2002 |
| EP | 1 224 441 | A1 | 7/2002 |
| EP | 1 634 558 | A1 | 3/2006 |
| EP | 1 635 153 | A2 | 3/2006 |
| EP | 1 893 955 | A1 | 3/2008 |
| GB | 1263385 | | 2/1972 |
| GB | 2307081 | | 5/1997 |
| WO | WO 90/10281 | | 9/1990 |
| WO | WO 94/27120 | | 11/1994 |
| WO | WO 0051541 | | 9/2000 |
| WO | WO 01/71298 | A1 | 9/2001 |
| WO | WO 03/001162 | A1 | 1/2003 |
| WO | WO 2004/069124 | A1 | 8/2004 |
| WO | WO 2005/054795 | A1 | 6/2005 |
| WO | WO 2007/083767 | A1 | 7/2007 |

* cited by examiner

BED EXIT ALERT SILENCE WITH AUTOMATIC RE-ENABLE

CROSS REFERENCE TO RELATED APPLICATIONS

This application is a continuation-in-part of U.S. application Ser. No. 12/845,870, filed Jul. 29, 2010, which is hereby expressly incorporated by reference herein.

BACKGROUND

The present disclosure relates to beds that are used in healthcare facilities and that have bed exit alert or alarm systems. More particularly, the present disclosure relates to beds having an alarm silence function that can be used to silence an audible alarm.

Hospital beds having bed exit alarms are known. Such beds typically have a local alarm, such as a buzzer or beeper, that sounds when the bed exit alarm is armed or enabled and the patient gets out of bed. Some such beds may also be configured to send an alert message to a nurse call system so that a nurse at a master station and/or caregivers carrying wireless communication devices, are alerted to the bed exit alarm condition. Many of the prior art beds also have an alarm silence button that, when pressed, turns off the bed exit alarm function of the bed and also stops an audible alarm, such as a beeper or buzzer, from sounding. Pressing the alarm silence button also may cancel the alert in the nurse call system.

In a typical scenario, when the bed exit alarm system is enabled with a patient on the bed, the alarm will sound when the patient gets out of the bed such as to go to the bathroom, for example. A caregiver will respond to the alarm, see that the patient is simply going to the bathroom, and then press the alarm silence button. Once the patient has finished going to the bathroom, the caregiver may even assist the patient in getting back into bed. However, on some occasions, caregivers forget to turn the bed exit alarm system back on. That is, a caregiver may, on occasion, forget to re-enable the alarm. Thus, the next time that the patient decides to get out of bed, no bed exit alarm sounds and no bed exit alert message is sent to the nurse call system.

SUMMARY

The present invention comprises one or more of the features recited in the appended claims and/or the following features which, alone or in any combination, may comprise patentable subject matter:

A hospital bed may include a patient support structure and a bed exit alarm system carried by the patient support structure. The bed exit alarm system may have an audible alarm that sounds when an alert condition is detected. The bed exit alarm system may further include at least one user input that is used to enable the bed exit alarm system when a patient is supported by the patient support structure. Thus, the audible alarm may sound if the bed exit alarm system is enabled and the alert condition is detected. The hospital bed may further have a bed exit alarm silence input. Use of the bed exit alarm silence input achieves at least one of stopping the audible alarm from sounding and preventing the alarm from sounding. Thus, use of the bed exit alarm silence input stops the audible alarm from sounding, either prior to the alarm actually sounding or after the alarm has begun to sound. The bed exit alarm system may be configured such that after the bed exit alarm silence input is used, the bed exit alarm system is re-enabled automatically without any action by a caregiver in response to the bed exit alarm system sensing that the patient is, once again, supported on the support structure.

The term "hospital bed" as used herein, is intended to cover beds used in all types of healthcare settings such as, for example, nursing homes and even a patient's residence, and is not intended to be limited to just those beds used in hospitals. When it is stated herein that the bed exit alarm system is "enabled" (as well as uses of other forms of the word "enable"), it is intended to mean that the bed exit system is "armed." That is, if the bed exit alarm system is enabled or armed, that means that the bed exit alarm system is on and a bed exit alarm will be activated in response to an alert condition being detected. On the other hand, if the bed exit alarm system is disabled or disarmed, that means that the bed exit alarm system is off. The terms "alert" and "alarm," as used herein, are each intended to have the broad meanings of both. The term "bed exit alarm system" is intended to cover systems that can alarm in response to patient movement, such as sitting up from a lying position or movement toward an edge or end of the bed and not just systems that alarm as a result of a bed exit.

The bed exit alarm system may include control circuitry and a plurality of sensors that produce signals from which the control circuitry may determine whether the alert condition exists. The plurality of sensors may comprise, for example, at least one load cell and/or at least one force sensitive resistor. The signals from the sensors may also be used by a weigh scale system of the bed.

The bed exit alarm silence input may comprise a button that is pressed or may comprise an icon on a graphical display screen that is touched. If a button is used, the button may comprise a membrane switch in some embodiments. However, other types of buttons, including touch sensors, are contemplated by this disclosure as well. The patient support structure may comprise a barrier, such as a footboard or siderail, and the bed exit alarm silence input may be located on the barrier. Alternatively or additionally, the bed exit alarm silence input may be provided on a wired or wireless caregiver pod or pendant. In some embodiments, the caregiver pod or pendant may detachably couple to a siderail of the bed.

In some embodiments, more than one button or user input may need to be pressed or touched to stop or suspend the bed exit alarm. For example, it is contemplated by this disclosure that an enable button or a key button may be pressed and then, within a threshold amount of time, an alarm silence button (aka alarm suspend button) may be pressed prior to a patient exiting the bed so as to preemptively stop the alarm from sounding if the patient does, in fact, exit the bed within a predetermined amount of time. In such embodiments, the bed exit alarm system will automatically be re-enabled when the patient returns to the bed.

According to some embodiments, the hospital bed may further include a first light coupled to the patient support structure. The first light may blink after the bed exit alarm silence input is used and prior to the bed exit alarm system being re-enabled automatically. The first light may be amber in color when blinking. The patient support may have a second light that also blinks after the bed exit alarm silence input is used and prior to the bed exit alarm system being re-enabled automatically. The second light may be on the barrier.

The second light may be associated with one of the user inputs that is used for enabling the bed exit alarm system in a particular mode. The bed exit alarm system may be enabled in a plurality of system modes, each system mode requiring a different amount of movement by the patient relative to the patient support structure before an alarm condition is considered to exist. The second light may be adjacent to an indicia on the barrier that indicates in which system mode of the plurality of system modes the bed exit alarm system has been enabled. The indicia may be on one of the user inputs.

The bed exit alarm system may be enabled in a first system mode in which movement by the patient relative to the patient support structure by a first amount is considered to be the alert condition. The bed exit alarm system also has an out-of-bed mode in which movement by the patient relative to the patient support structure by a second amount, greater than the first amount, is considered to be the alert condition. If the bed exit alarm system was enabled in the first mode prior to the bed exit alarm silence input being used, the bed exit system may first re-enable in the out-of-bed mode as an interim step as the patient enters onto the patient support structure and then may re-enable in the first mode after the patient has more fully moved onto the patient support structure. In some embodiments, the bed exit alarm system re-enables in the out-of-bed mode in response to a threshold amount of weight being detected as being added to the patient support structure.

According to this disclosure, the at least one user input may also be used for manually disabling the bed exit alarm system. In some embodiments, the at least one user input may include a key button and a plurality of mode buttons, each of the mode buttons corresponding to a mode of operation of the bed exit alarm system. The bed exit alarm system may be configured so that, if the bed exit alarm system is disabled, the bed exit alarm system becomes enabled in response to the key button and a selected one of the plurality of mode buttons being pressed simultaneously or the key button being pressed for a threshold amount of time and then one of the plurality of mode buttons being pressed within a short time period thereafter. Similarly, the bed exit alarm system may be configured so that, if the bed exit alarm system is enabled, the bed exit alarm system becomes disabled in response to the key button and a selected one of the plurality of mode buttons being pressed simultaneously or the key button being pressed for a threshold amount of time and then the appropriate one of the plurality of mode buttons being pressed within a short time period thereafter.

The hospital bed may have a power plug coupled to the patient support structure. The bed exit alarm system may become disabled in response to the power plug being unplugged from a power source regardless of whether the bed exit alert silence input has been used. The bed exit alarm system may be configured to sound an arming tone after the bed exit alarm system is re-enabled automatically.

After the bed exit alarm silence input is used, a first message may be transmitted from the bed to a remote computer device to indicate that the bed exit alarm system is in a suspend mode. After the bed exit alarm system is re-enabled automatically, a second message may be transmitted from the bed to the remote computer device to indicate that the bed exit alarm system is no longer in the suspend mode and is re-enabled. The remote computer device may comprise a master station computer or console of a nurse call system, for example. The remote computer device may display information indicating whether the bed exit alarm system of the hospital bed is enabled, alarming, suspended, or disabled. The remote computer device may display this type of information for a plurality of hospital beds.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
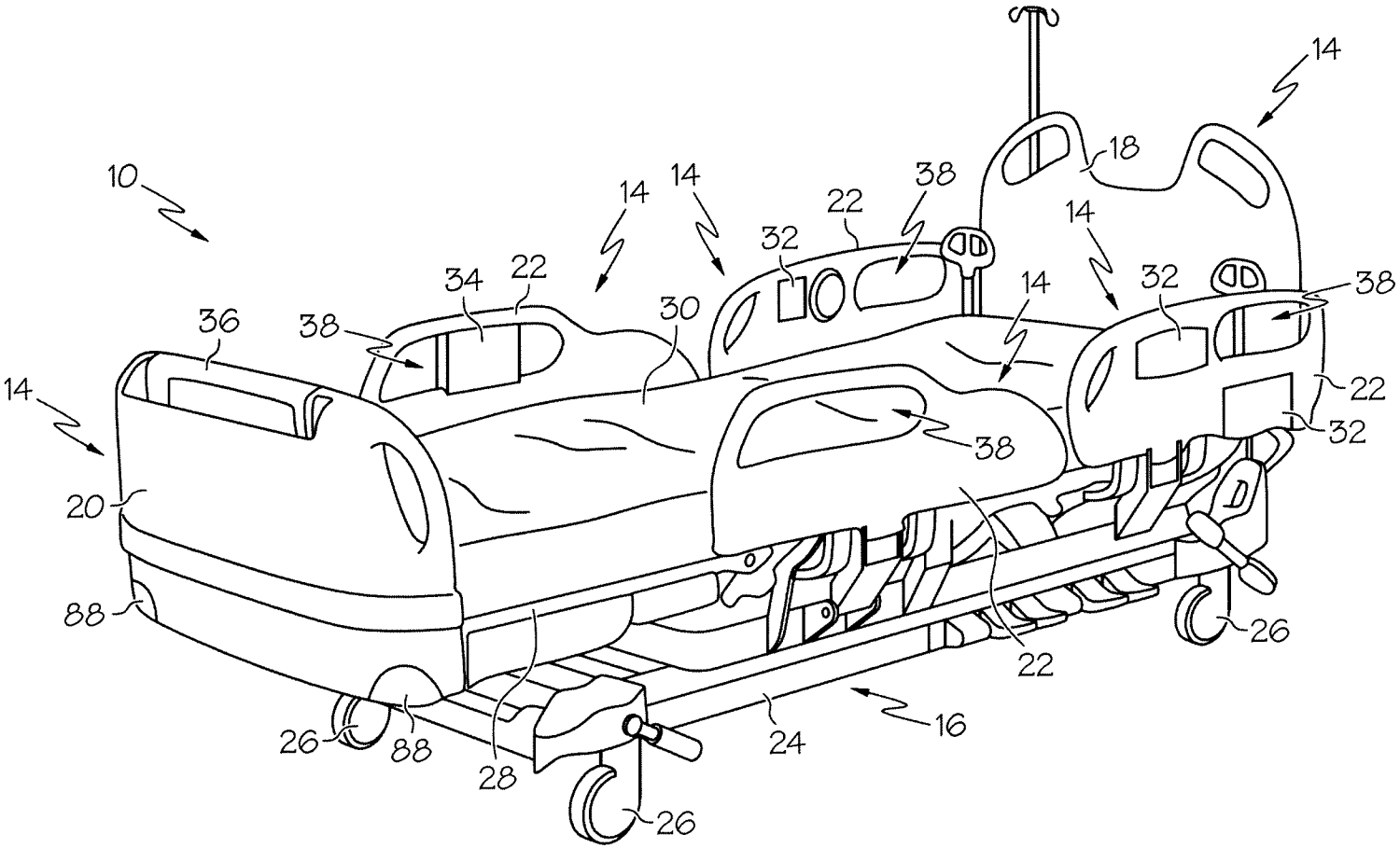
FIG. 1 is a perspective view of a hospital bed.
Figure 4:
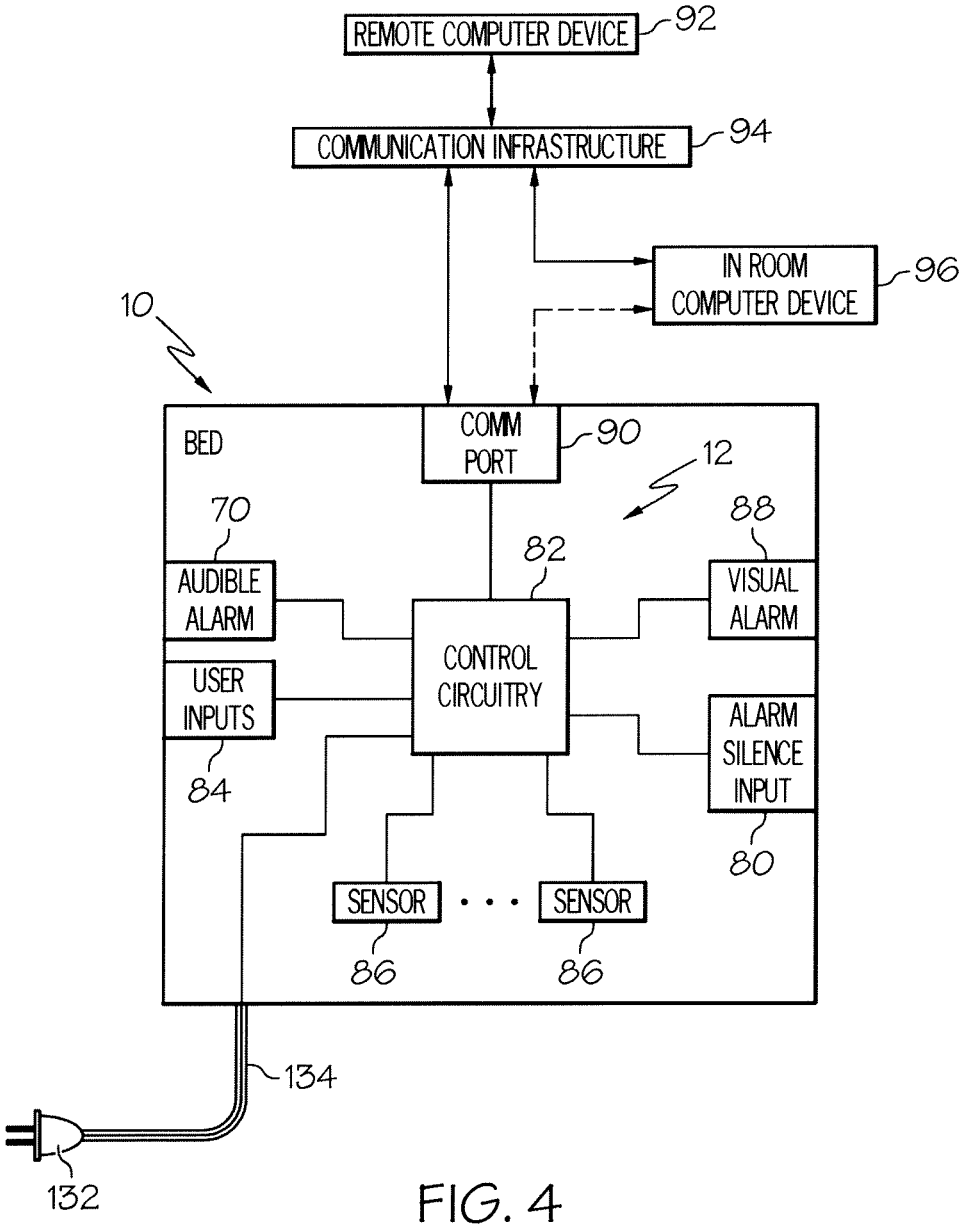
FIG. 4 is a block diagram showing basic components of the bed exit alarm system of the bed and showing the bed communicating through communication infrastructure with a remote computer device and an in-room computer device.

According to this disclosure, a hospital bed 10, shown in FIG. 1, includes a bed exit alarm system 12, shown diagrammatically in FIG. 4, which has an auto re-enable function or feature. The auto re-enable feature is unique in that no hospital beds known heretofore include such a feature. While the auto re-enable feature disclosed herein may be implemented on any type of hospital bed having a bed exit alarm system, illustrative hospital bed 10, as shown in FIG. 1, is a VersaCare® bed available from Hill-Rom Company, Inc. As such, the details of bed 10 can be found, in large part, in U.S. Pat. Nos. 6,658,680; 6,691,346; 6,957,461; and 7,296,312 each of which is hereby incorporated by reference herein.

Bed 10 has a number of barriers 14 coupled to a bed frame 16 as shown in FIG. 1. Barriers 14 include a headboard 18, a footboard 20, and siderails 22. Frame 16 includes a base frame 24 with casters 26 and an upper frame 28 to which siderails 22 are coupled. Upper frame 16 includes a number of mattress support sections that support a mattress 30. In FIG. 1, all of the siderails 22 are shown in a raised position. However, each siderail 22 is movable form the raised position to a lowered position to permit a patient to get on and off the mattress 30 of bed 10. Thus, frame 16 or mattress 30 or both serves as a patient support structure of bed 10. The term "patient support structure" as used in the claims is intended to cover all types of mattresses and/or bed frames, including bariatric mattresses or bed frames. Typically, a mattress or support surface, such as mattress 30, is present when beds are used to support patients, but the mattress and bed frames are often sold separately.

Bed 10 has a number of user input panels or control panels, including user input panels 32 that are affixed to the siderails closest to the head end of bed 10, a hand-held pendant or pod 34 removably coupled to one of the siderails 22 closest to the foot end of bed 10, and another user input panel 36 coupled to footboard 20. Pendant 34 is configured to snap into openings 38 provided in each siderail 22. Pendant 34 can be detached from each siderail 22 and held by a patient or caregiver during use. Control panel 36 is movable from a storage position, shown in FIG. 1, to a use position by pulling panel 36 upwardly relative to footboard 20.

Figure 2:
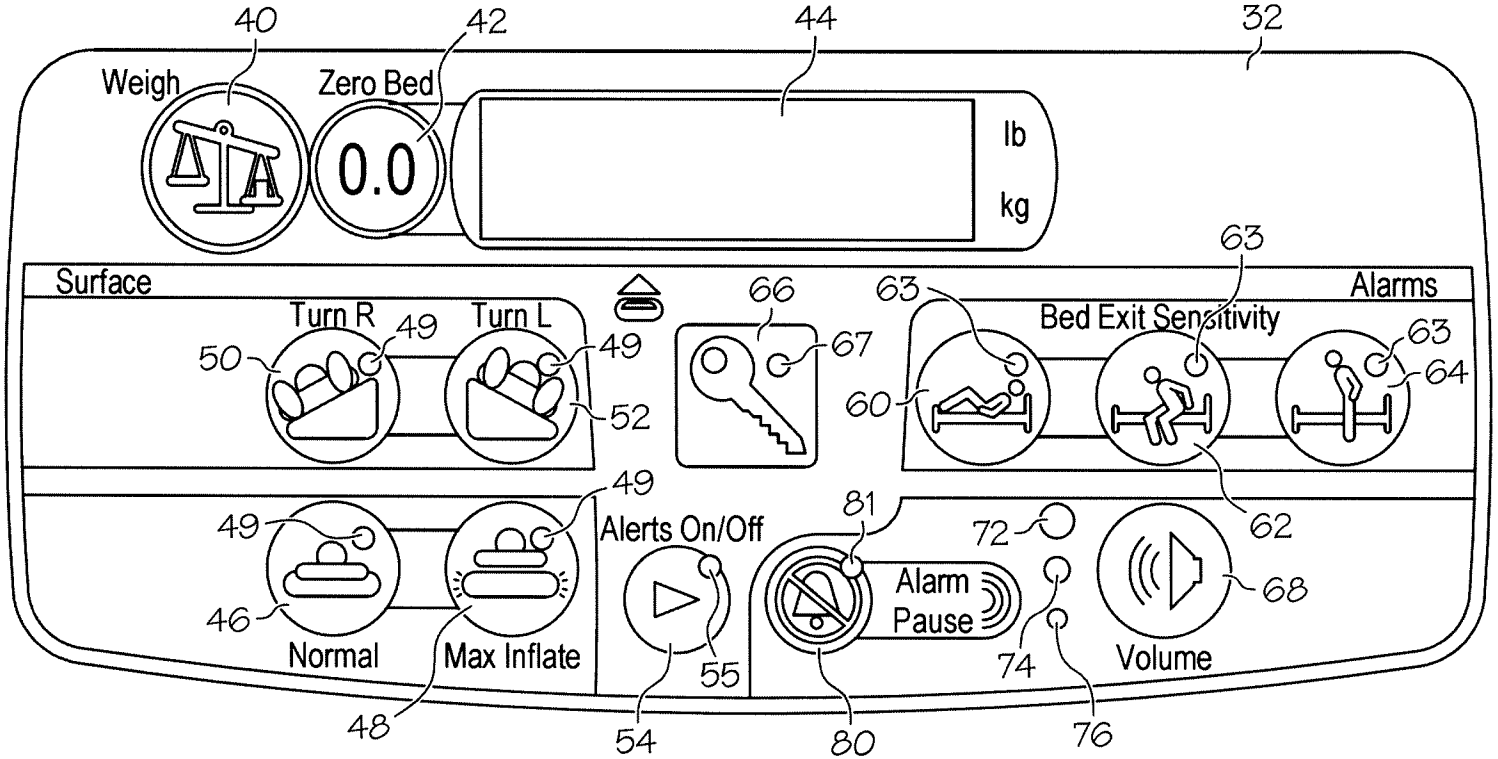
FIG. 2 is a front elevation view of a user input panel having user inputs for controlling the operation of a bed exit alarm system of the hospital bed and having an alarm silence/alarm pause input.

Referring now to FIG. 2, one of the control panels 32 affixed to the head end siderails 22 includes various user inputs that control scale, surface, and bed exit alarm system functions of bed 10. Alternatively or additionally, the same type of user inputs for controlling these same functions can be provided on pendant 34 and control panel 36. In the illustrative example, the user inputs are buttons that are pressed to close contacts of a membrane switch, but other types of user inputs may be used if desired. For example, a touch screen display would be one suitable alternative.

The control panel 32 of FIG. 2 includes a weigh button 40 that is pressed to take a patient weight reading, a zero bed button 42 that is pressed prior to the patient getting on the bed to set a tare weight of the scale system, and a display screen 44 on which the patient's weight is displayed. Control panel 32 also has a normal button 46 that is pressed to signal a mattress control system to inflate mattress air bladders to target pressures that are normal for supporting a patient. A max inflate button 48 of panel 32 is pressed to inflate the air bladders of the mattress to their maximum target pressures such when a patient is being transferred laterally from bed 10 onto a stretcher for transport. Panel has a right turn button 50 and a left turn button 52 that are used to inflate a right turn bladder and a left turn bladder, respectively, to turn a patient onto their right side or left side. Each of buttons 46, 48, 50, 52 has an LED 49 that is lit during the time that the function corresponding to buttons 46, 48, 50, 52 is in operation.

Panel 32 of FIG. 2 also has an Alerts On/Off button 54 that that can be pressed to turn on and off, alternately, the alerting function of bed 10. When the alert function is on, signals are transmitted from bed 10 to alert caregivers at remote locations of designated alert conditions. The caregivers are notified of the alerts at a master nurse call station computer, for example, and in some instances, on the display screens of portable wireless communication devices carried by the caregivers. The alerts that are communicated include, for example, siderail down alerts, brake not set alerts, bed exit or patient movement alerts, and so forth. U.S. Pat. No. 7,319,386 includes a discussion of selecting the bed alert types to which caregivers are to be notified and is hereby incorporated by reference herein. Button 54 has an LED 55 that is lit when the alerting function of bed 10 is turned on.

Panel 32 of FIG. 2 also has first, second and third buttons 60, 62, 64 that are used to select the sensitivity level of the bed exit alarm system 12 of bed 10. Thus, in the illustrative example, the bed exit alarm system 12 of bed 10 has three modes of sensitivity. However, bed exit alarm systems having more or less than three modes of sensitivity are within the scope of this disclosure. The sensitivity level dictates the amount that the patient must move on bed 10 before an alert condition is considered to exist. In some embodiments, to select the level of sensitivity of the bed exit alarm system 12, an enable button 66 is pressed simultaneously with pressing the desired one of buttons 60, 62, 64. In some embodiments, the simultaneous pressing of button 66 along with one of buttons 60, 62, 64 must occur for a short duration, such as two seconds for example. In other embodiments, the enable button 66 is pressed for a threshold amount of time, such as two seconds, and then one of the plurality of mode buttons is pressed within a short time period thereafter, such as within two seconds. Once system 12 is enabled, LED 67 is no longer lit and the LED 63 corresponding to the sensitivity level in which system 12 is enabled is lit. After system 12 becomes enabled, a short tone will sound to indicate that the bed exit alarm system 12 has been successfully enabled.

When buttons 60, 66 are used to enable system 12, the bed exit alarm system 12 is enabled in a patient movement mode in which only a slight amount of movement of the patient, such as the patient sitting up in bed, for example, causes system 12 to alarm. When buttons 62, 66 are used to enable system 12, system 12 is enabled in a patient exit mode in which movement of the patient toward exiting the bed by a sufficient amount to constitute an impending exit from the bed 10 causes system 12 to alarm. When buttons 64, 66 are used to enable system 12, system 12 is enabled in an out-of-bed mode in which the patient has, at least partially, moved off of the bed by transferring a threshold amount of weight onto a floor of a room in which bed 10 is situated, for example. In other embodiments, the out-of-bed mode may correspond to a large amount of movement of the patient toward exiting the bed, but prior to the transfer of any of the patient's weight off of the bed. When system 12 is enabled, an LED 63 of the button 60, 62, 64 corresponding to the mode in which system 12 is enabled is lit as is an LED 67 of button 66.

Panel 32 of FIG. 2 has a volume button 68 that is pressed to toggle through different volume settings to select a volume at which an audible alarm 70, shown diagrammatically in FIG. 4, sounds when activated. According to this disclosure, audible alarm 70 can be any sound producing device such as, for example, a speaker, horn, or buzzer. In one embodiment, audible alarm 70 is a piezoelectric buzzer. First, second, and third LED's 72, 74, 76 are situated adjacent to button 68 and are lit to indicate the selected volume level. Sequential presses of button 68 scrolls through high, medium, and low volume levels. LED 72 corresponds to the high volume level, LED 74 corresponds to the medium volume level, and LED 76 corresponds to the low volume level. LEDs 72, 74, 76 have different sizes to provide the user with a visual indication of the volume level selected. LED 72 is bigger than LED 74 and LED 76 is smaller than LED 74 in this regard.

Panel 32 of FIG. 2 has an alarm pause button or user input 80 which is sometimes referred to herein as an alarm silence input or an alarm suspend input. In some embodiments, button 80 is pressed to silence the sounding of alarm 70 after an alert condition has been detected by system 12. That is, button 80 only has any affect on system 12 after an alarm condition has been detected. Accordingly, in such embodiments, button 80 cannot be used to preemptively stop the alarm 70 from sounding. So, in the illustrative example, after system 12 is enabled, if a caregiver wants to have the patient exit bed 10 without the alarm 70 sounding, the caregiver will disable the alarm system altogether by simultaneously pressing button 66 and the button 60, 62, 64 corresponding to the mode in which system 12 is currently enabled or by button 66 being pressed for a threshold amount of time and then one of the plurality of mode buttons 60, 62, 64 being pressed within a short time period thereafter. A short tone will sound when system 12 becomes disabled. When button 80 is pressed after system 12 detects a bed exit alert condition, an LED 81 of button 80 is lit, such as by blinking or flashing.

Embodiments in which system 12 is configured to preemptively stop the sounding of alarm 70 in response to pressing button 80 when system 12 is enabled and the patient is in bed 10 are, however, contemplated by this disclosure. In some such embodiments, the caregiver first presses enable or key button 66 and then within a threshold amount time presses alarm suspend input 80 while the patient is still on bed 10. After buttons 66, 80 are pressed to preemptively suspend the alarm from occurring the patient has a predetermined amount of time, such as 30 seconds for example, to exit the bed. If the predetermined amount of time passes and the patient has not exited the bed, system 12 becomes re-enabled such that a subsequent bed exit by the patient will cause the alarm to sound. If the patient exits the bed 10 during the predetermined period of time, the audible alarm 70 is not activated and then system 12 automatically becomes re-enabled in response to the patient returning to bed 10 as described more thoroughly below.

Referring now to FIG. 4, system 12 has control circuitry 82 that is electrically coupled to audible alarm 70 and alarm silence input 80. Circuitry 82 is also electrically coupled to buttons 60, 62, 64, 66, 68 which, in FIG. 4, are illustrated generically as user inputs 84. Circuitry 82 is also coupled to one or more sensors 86 that are used to detect the movement of the patient on bed 10 and/or the exit of the patient from bed 10. In one embodiment, sensors 10 are load cells that are included as part of bed frame 16. The load cells each include strain gage elements that are mounted to a mass of material, such as a metal material like aluminum, and that change resistance based on an amount that the mass of material of the load cell is deflected. A discussion of how the use of load cells as sensors 86 may provide different bed exit modes of varying levels of sensitivity can be found in U.S. Pat. No. 7,253,366 which is hereby incorporated by reference herein. Signals from the load cells are also used by the weigh scale system of bed 10 to calculate patient weight.

Sensors 86 of system 12 can include other types of sensing devices in other embodiments. For example, suitable sensors may include force sensitive resistors (FSRs) that are placed beneath the mattress 30 of the bed 10 on the mattress support deck. In fact, one example in which FSRs are used in combination with load cells in a bed exit alarm system is described in U.S. Pat. No. 7,296,312 which is already incorporated by reference herein. Other examples in which FSRs are used as part of a bed exit alarm system are shown and described in U.S. Pat. Nos. 7,464,605 and 6,208,250 which are both hereby incorporated by reference herein. Other types of contemplated sensors include capacitive sensors such as those shown and described in U.S. Pat. No. 5,808,552 which is hereby incorporated by reference herein and tape switches such as those shown and described in U.S. Pat. No. 4,539,560 which is hereby incorporated by reference herein. Thus, according to this disclosure sensors 86 of a bed exit system 12 can be of one type, such as load cells, FSRs, tape switches, or capacitive sensors, just to name a few, or can be of different types, such as using combinations of the sensors mentioned herein.

In the illustrative embodiment, bed 10 has alert lights 88 provided at the bottom corners of upper frame 28 at the foot end of bed 10 as shown in FIG. 1. Lights 88 are activated in different ways to indicate the condition of bed 10. When no alerts or alarms exist, lights 88 are activated to shine green, for example. When an alert or alarm occurs, including a bed exit alarm, lights 88 are activated to shine red and, in some embodiments, to blink. When alarm silence input 80 is pressed, alert lights 88 shine amber and, in some embodiments such as the illustrative one, are operated to blink. Lights 88 are illustrated diagrammatically in FIG. 4 as visual alarm 88. Other visuals alarms 88 that may be used in addition to, or instead of lights 88, include graphical display screens that change background color, for example, and may even include IV pole mounted or wall mounted devices such as lights or graphical display screens.

Control circuitry 82 of bed 10 is electrically coupled to a communication port 90 as shown diagrammatically in FIG. 4. Port 90 is communicatively coupleable to a remote computer device 92 via communication infrastructure 94. Thus, data is transmitted from bed 10 to computer device 92 via infrastructure 94 and data is received by bed from computer device 92 via infrastructure 94 in the illustrative example. Bed 10 also communicates with an in-room computer device 96 via communication infrastructure 94. In an alternative arrangement, in-room computer device 96 couples to port 90 directly as indicated by the dashed line between device 96 and port 90 in FIG. 4.

Remote computer device 92 is a master nurse call station or console and in-room computer device 96 is an audio station or graphical room station in some embodiments. The communication infrastructure 94 includes the various electrical and communications equipment that interconnects bed 10 with devices 94, 96. Thus, devices 92, 96 and infrastructure 94 may comprise part of a dedicated nurse call system in some embodiments. Infrastructure 94 may comprise part of an Ethernet of a healthcare facility in other embodiments. Examples of the types of equipment used to interconnect beds with remote computer devices and in-room computer devices can be found in U.S. Pat. No. 7,319,386 which is already incorporated by reference herein, U.S. Pat. No. 7,538,659 which is hereby incorporated by reference herein, and in U.S. Patent Application Publication Nos. 2009/0217080; 2009/0212956; and 2009/0212925 which are hereby incorporated by reference herein.

When alert silence input 80 is engaged (or when inputs 66, 80 are engaged in those embodiments having the preemptive alarm silence feature), system 12 enters into a suspend mode in which the sounding of alarm 70 is silenced. Furthermore, in response to system 12 being put into the suspend mode, control circuitry 82 transmits a message destined for remote computer device 92 and/or in room computer device 96 if those devices 92, 96 happen to be communicatively coupled to bed 10. Computer devices 94, 96 have display screens to display a message or icon or to otherwise visually indicate that system 12 of bed 10 is in the suspend mode. For example, a bed exit icon or field that is associated with bed 10 may change colors on the display screen of devices 94, 96 in response to the message indicating that system 12 has entered the suspend mode.

Control circuitry of bed 82 includes, among other things, at least one microcontroller or microprocessor and memory devices that stores software which controls the operation of the bed exit alarm system 12. Circuitry 82 as illustrated diagrammatically in FIG. 4 represents all of the circuitry of bed 10, including the portion of the circuitry dedicated to the bed exit alarm system 12. In some embodiments, circuitry 82 comprises various circuit modules that interconnect in a network configuration, such as a controller area network (CAN). The details of this sort of bed network configuration are shown and described in U.S. Pat. Nos. 6,658,680; 6,691,346; 6,957,461; and 7,296,312 which are already incorporated by reference herein.

Figure 3A:
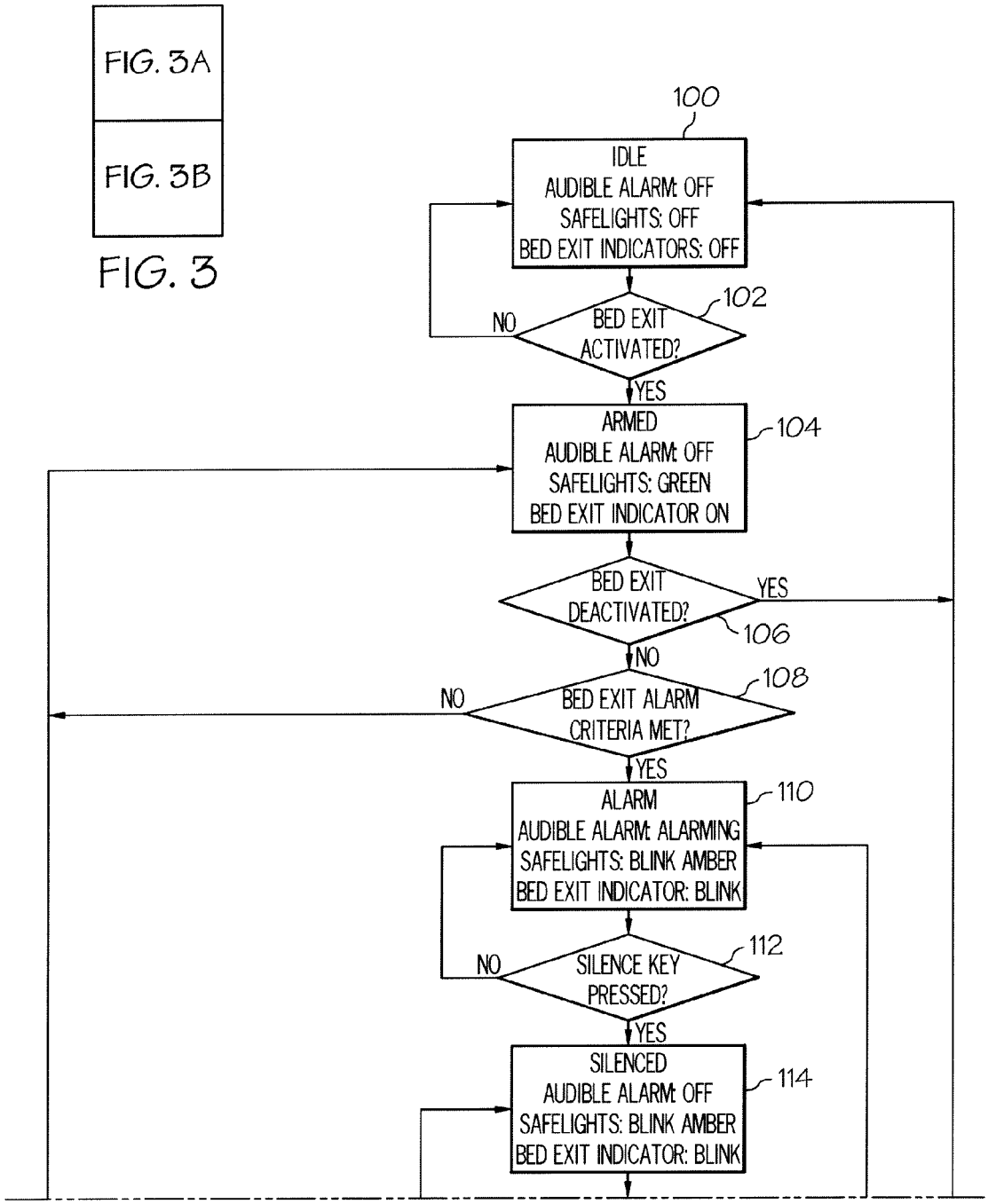
FIG. 3 is a template showing how FIGS. 3A and 3B fit together to form a flow chart of an algorithm that includes steps for automatically re-enabling the bed exit alarm system after the alarm silence button has been used.
Figure 3B:
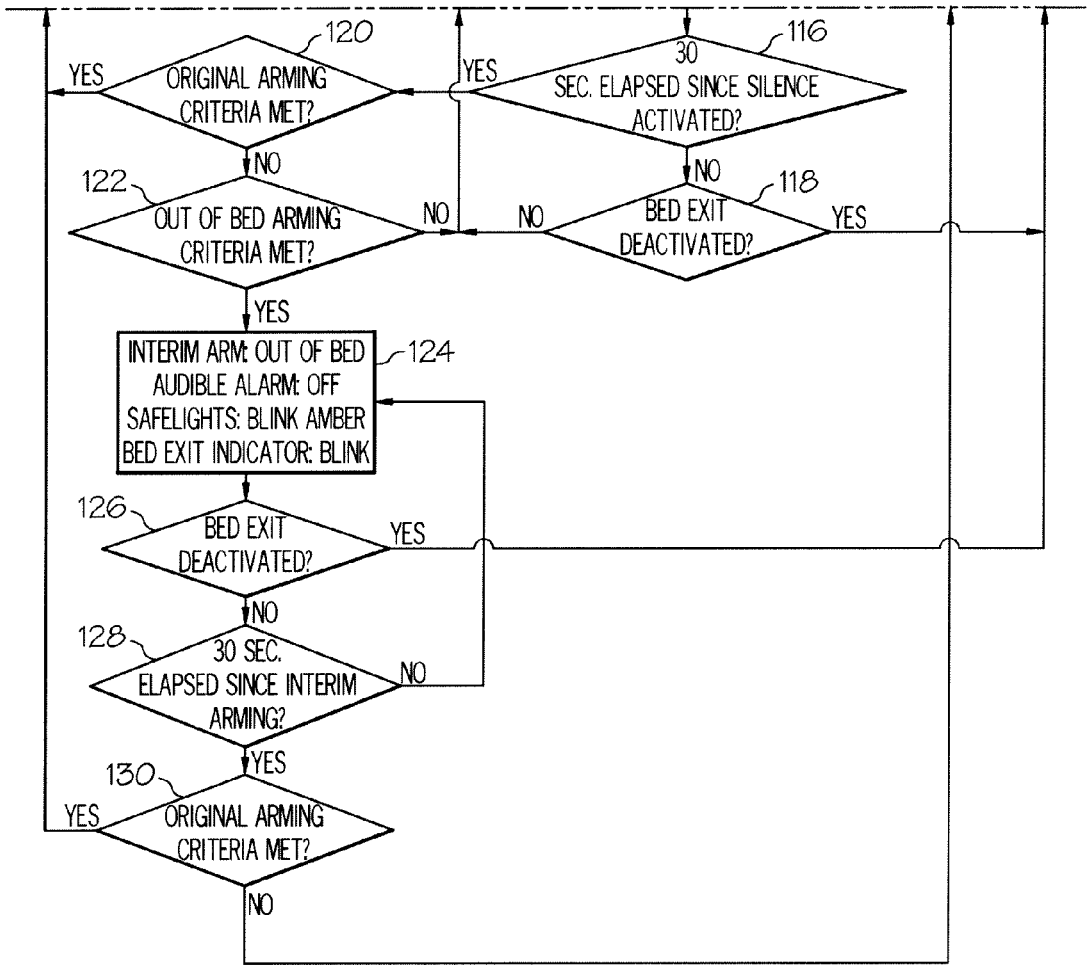

As alluded to above, bed exit alarm system 12 has an auto re-enable feature. An algorithm which is illustrative of the software that is stored in circuitry 82 of system 12 and that implements the auto re-enable feature is shown in FIGS. 3A and 3B. As indicated at block 100, system 12 has an idle mode in which system 12 is disabled or not enabled. In the idle mode, in which the patient's movement toward exiting the bed 10 is not even monitored, alarms 70, 88 are off as are the LED's 63 that are associated with buttons 60, 62, 64. In FIGS. 3A and 3B the term "safelights" is referring to lights 88 and the term "bed exit indicators" is referring to LED's 63. In the algorithm depicted in FIGS. 3A and 3B, the state of alarms 70, 88 is relative only to bed exit alarm system 12. Other conditions of bed 10 being monitored may result in alarms 70, 88 being activated even though a bed exit alarm does not exist.

As indicated at block 102, system 12 checks to determine if it has been enabled in any of its bed exit modes (e.g., the patient movement, patient exit, and out-of-bed modes discussed above). If system 12 has not been enabled, then the algorithm returns to block 100. If system has been enabled, then the algorithm proceeds to block 104 which corresponds to an armed mode in which alarm 70 is off, lights 88 shine green, and the LED 63 corresponding to the mode in which system 12 is enabled is on or lit. When enabling system 12, a caregiver may check to determine that the patient is properly positioned on mattress 30 such as making sure the patient is generally centered between the sides of the bed and, in some embodiment, that the patient's hips are generally aligned with a hip locator such as an indicia on upper frame 28 or on one of siderails 22.

As indicated at block 106, after the system is armed, the algorithm determines whether system 12 has been deactivated or disabled or disarmed. If system 12 has been deactivated, the algorithm returns to block 100. If the system 12 has not been deactivated, then system 12 is still enabled, and the algorithm proceeds to block 108. As indicated at block 108, system 12 determines whether bed exit alarm criteria have been met. If the bed exit alarm criteria are not met, then the algorithm returns to block 104 as indicated in FIG. 3A. If the bed exit alarm criteria are met, then system 12 is in an alarm mode and the algorithm proceeds to block 110.

As indicated at block 110, when system 12 is in the alarm mode, audible alarm 70 is activated, lights 88 blink amber, and the LED 63 associated with the mode in which system 12 is enabled blinks. In some embodiments, when an alarm condition is detected, a message such as "bed exit alarm" is displayed on display screen 44 and optionally, the displayed message may flash. While system 12 is alarming in the alarm mode, the algorithm checks to determine if alarm pause button 80 (referred to as a "silence key" in FIG. 3A) has been pressed as indicated at block 112. If button 80 has not been pressed, then the algorithm returns to block 110 and the alarming continues. If button 80 has been pressed, the algorithm proceeds to a silenced or suspend mode as indicated at block 114.

In the silenced or suspend mode of block 114, audible alarm 70 is off, lights 88 continue to blink amber, and the bed exit indicator (i.e., the LED 63 associated with the mode in which the system 12 was enabled) continues to blink. As indicated at block 116 of FIG. 3B, after the algorithm enters the silenced mode, system 12 determines whether a threshold amount of time has elapsed, which in the illustrative example, is 30 seconds. If the threshold amount of time has not elapsed, system 12 proceeds to block 118 and determines whether bed exit alarm system has been deactivated via the use of button 66 and the button 60, 62, 64 corresponding to the mode in which system 12 was enabled. If at block 118 it is determined that system 12 has been deactivated, the algorithm proceeds back to the idle mode of block 100. If at block 118 it is determined that system 12 has not been deactivated, system 12 remains in the silenced mode and the algorithm returns to block 114.

If at block 116 it is determined that the threshold amount of time has elapsed, then system 12 checks to determine whether the original arming criteria is met as indicated at block 120. At block 120, therefore, system 12 is checking to determine whether the patient has returned to the bed. This is done in the illustrative embodiment by determining whether a sufficient amount of weight, as measured by the scale system of bed 10, has returned to the bed 10 and is not distributed in a manner that would violate the original arming criteria corresponding to the selected sensitivity in which system 12 was originally armed. If at block 120 it is determined that the original arming criteria has been met, then system 12 of bed 10 is automatically re-enabled and the algorithm returns to the armed or enabled mode of block 104. A short tone sounds when system 12 is re-enabled or re-armed.

As is evident in the algorithm of FIGS. 3A and 3B, when the patient returns to bed 10 when system 12 is in the silenced or suspend mode and the patient returns to a proper position on bed 10, system 12 is enabled or armed without the need for a caregiver to manipulate any of the user inputs of bed 10. This alleviates the problems that may arise due to a caregiver forgetting to re-enable the bed exit alarm system 12 after a patient returns to bed 10.

If at block 120, it is determined that the original arming criteria is not met, then the algorithm proceeds to block 122 to determine whether the out of bed arming criteria. Thus, at block 120, system 12 is checking to determine whether the patient is in the process of getting back on bed 10 and has gotten onto the bed an amount sufficient to meet the less sensitive criteria of the out-of-bed mode but not the more sensitive criteria of the patient exit mode or patient movement mode. If at block 122 the out of bed arming criteria has not been met, then the algorithm returns to block 114.

If at block 122 the out of bed arming criteria has been met, then system 12 enters into an interim out of bed arming mode as indicated at block 124. In the interim out of bed arming mode, audible alarm 70 continues to be turned off, lights 88 continue to blink amber, and the bed exit indicator (i.e., the LED 63 associated with the mode in which the system 12 was enabled) continues to blink. In the illustrative example, if system 12 enters into the interim out of bed arming mode, the bed exit alarm activation tone does not sound. The tone only sounds when the originally armed mode is re-established in the illustrative example. However, it is within the scope of this disclosure for the bed exit alarm activation tone to sound when system 10 enters into the interim out of bed arming mode. It will be appreciated that, if system 12 was originally enabled or armed in the out-of-bed mode, the algorithm will not proceed to block 122 from block 120 because the original arming criteria is the out-of-bed mode criteria in that instance and the "yes" branch from block 120 will be followed when the out-of-bed mode criteria is met.

After entering the interim out of bed arming mode, the algorithm proceeds to block 126 and determines whether the bed exit alarm system has been deactivated altogether by appropriate use of buttons 60, 62, 64, 66 as described above. If system 12 has been deactivated as determined at block 126, the algorithm returns to block 100. If the system 12 has not been deactivated as determined at block 126, the algorithm continues to block 128 and determines whether a threshold amount of time, which is 30 seconds in the illustrative embodiment, has elapsed since system 12 entered the interim out of bed arming mode. If the threshold amount of time of block 128 has not elapsed, the algorithm returns to block 124 and system 12 remains in the interim out of bed arming mode.

If at block 128 it is determined that the threshold amount of time has elapsed, then the algorithm proceeds to block 130 to determine whether the original arming criteria has been met. If at block 130 it is determined that the original arming criteria has not been met, then the algorithm proceeds to block 110 and reactivates or sounds the audible alarm 70 along with continuing to blink lights 88 amber and continuing to blink the bed exit indicators. If at block 130 it is determined that the original arming criteria has been met, then the algorithm proceeds back to the armed mode of block 104. Thus, in the illustrative example, once system 12 enters the interim out of bed arming mode, the patient has 30 seconds to return to the proper position on bed 12 or else a new alarm will sound.

As shown diagrammatically in FIG. 4, bed 10 has a power plug 132 at the end of a power cord 134. Plug 132 couples to a standard power outlet so that power is supplied to bed 10. The algorithm shown in FIGS. 3A and 3B is drawn under the assumption that plug 132 of bed 10 is plugged into a power outlet. If plug 132 of bed 10 becomes disconnected, the bed exit alarm system 12 automatically becomes disabled regardless of the portion or mode of the algorithm of FIGS. 3A and 3B in which system 12 is otherwise operating.

In some embodiments, messages from bed 10 are sent to remote computer device 92 and/or in-room computer device 96 to indicate entry into the various modes mentioned above in connection with the algorithm of FIGS. 3A and 3B. As indicated above, text in various fields and/or icons may be changed on the graphical display screens of devices 92, 96 in response to bed exit alarm system 12 changing modes of operation. The remote computer devices 92 include hand held portable wireless devices carried by caregivers in some embodiments.

In some embodiments, the remote computer device 92 and the in-room computer device 96 includes devices forming part of a locating and tracking system. In a locating and tracking system, caregivers wear badges or tags that transmit signals which are sensed by receivers of the locating and tracking system. Thus, device 96 comprises a locating and tracking system receiver in some instances. When device 96 senses the presence of a caregiver in a room, that information is communicated to computer device 92 for storage in a database in some embodiments. It is contemplated by this disclosure that, in some embodiments, remote computer device 96 sends a message via infrastructure 94 to bed 10 to preemptively suspend alarm 70 from sounding when an alert condition of system 12 occurs if a caregiver is present in the room. In such an embodiment, it is contemplated that bed exit alarm system 12 will automatically re-enable when the patient returns to bed 10 as discussed above.

As is evident from the above discussion of FIGS. 3A and 3B, system 12 of bed 10 will remain perpetually in the suspend mode until a sufficient amount of weight, assumed to be the patient, returns to the bed unless the bed 10 becomes unplugged or a caregiver manipulates buttons 60, 62, 64, 66 to turn off the bed exit alarm system altogether. In an alternative embodiment of hospital bed 10, the bed exit alarm system remains in a silenced or suspend mode for a threshold amount of time and then the bed exit alarm system either (i) automatically re-alarms if the weigh scale system does not sense an appropriate amount of weight has returned to the bed and is positioned appropriately for the mode in which the bed exit alarm was originally enabled, or (ii) automatically re-enables if the weigh scale system senses that an appropriate amount of weight, assumed to be the patient, has returned to the bed and is positioned appropriately for the mode in which the bed exit system was originally enabled. In this alternative embodiment, there is no interim out of bed arming mode of the type described above.

Figure 5:
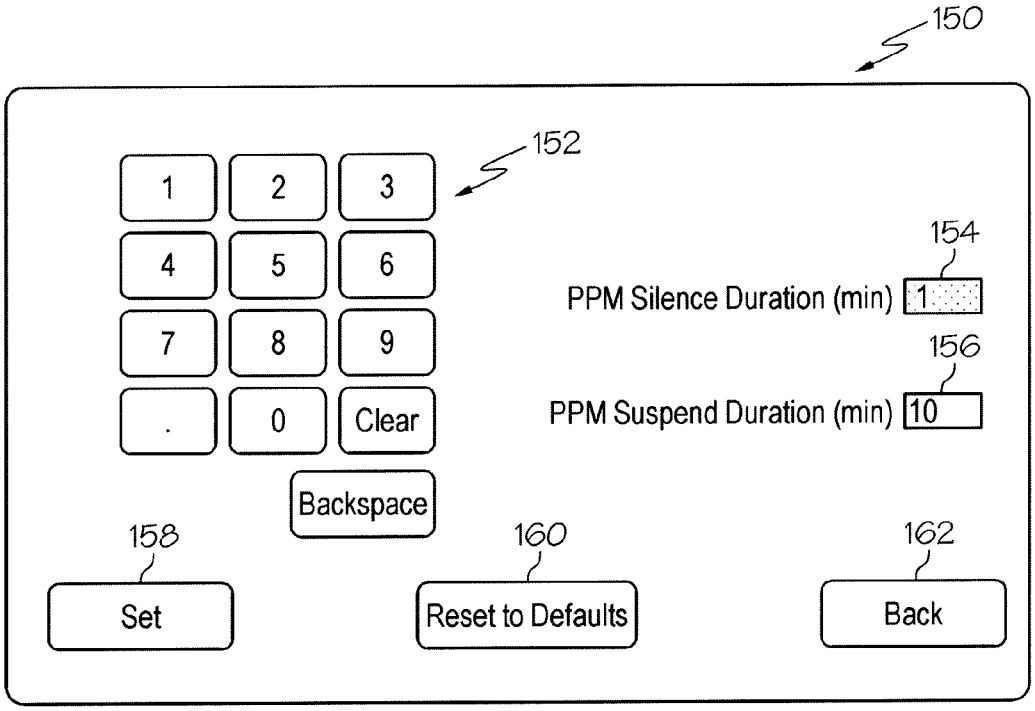
FIG. 5 is a screen shot showing an Alarm Silence Durations screen that appears on a graphical display screen of an alternative hospital bed and that has fields for entry of a silence duration and a suspend duration.

Referring now to FIG. 5, an Alarm Silence Durations screen 150 appears on a graphical display screen of the alternative embodiment of bed 10. Screen 150 is a touch screen display and has a keypad 152 with 1-9 buttons, a decimal button, a "clear" button, and a "backspace" button. Screen also has a silence duration field 154 and a suspend duration field 156 in which a user enters threshold amounts of time for the silence and suspend durations to be discussed below. A user simply touches whichever of fields 154, 156 the user wishes to edit and then uses the buttons of keypad 152 to enter the desired threshold durations. After editing one or both of fields 154, 156, the user presses a "Set" button 158 to store suspend and silence durations in memory of the control circuitry of the bed exit alarm system of the alternative hospital bed 10. In the illustrative example, the silence duration threshold can be selected by the user to be any time value between 1 and 5 minutes and the suspend duration threshold can be selected by the user to be any time value between 1 and 30 minutes. Of course, bed exit alarm systems having other time duration ranges are within the scope of this disclosure.

If the user wishes to reset fields 154, 156 to default times, the user presses a "Reset to Defaults" button 160 and the default silence and suspend times are stored in the memory of the control circuitry of the bed exit alarm system of the alternative hospital bed 10. In the illustrative example, the defaults silence and suspend times are one minute and ten minutes, respectively. If the user does not wish to make any changes to fields 154, 156, the user presses "Back" button 162 to return to a prior screen, such as a Main screen or Home screen, for example. In some embodiments, after either of buttons 158, 160 are pressed, screen 150 returns to the Main or Home screen as well.

Figure 6:
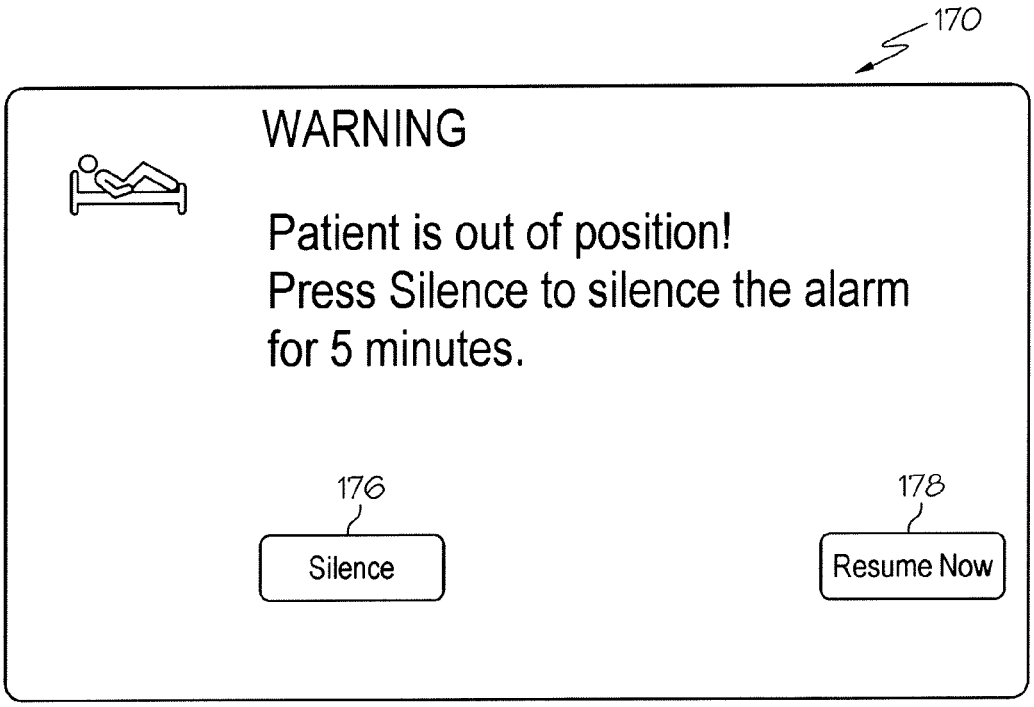
FIG. 6 is a screen shot showing a first alarm screen that appears on the graphical display screen in response to an alarm condition when a bed exit alarm system is enabled or armed in a patient movement mode.
Figure 7:
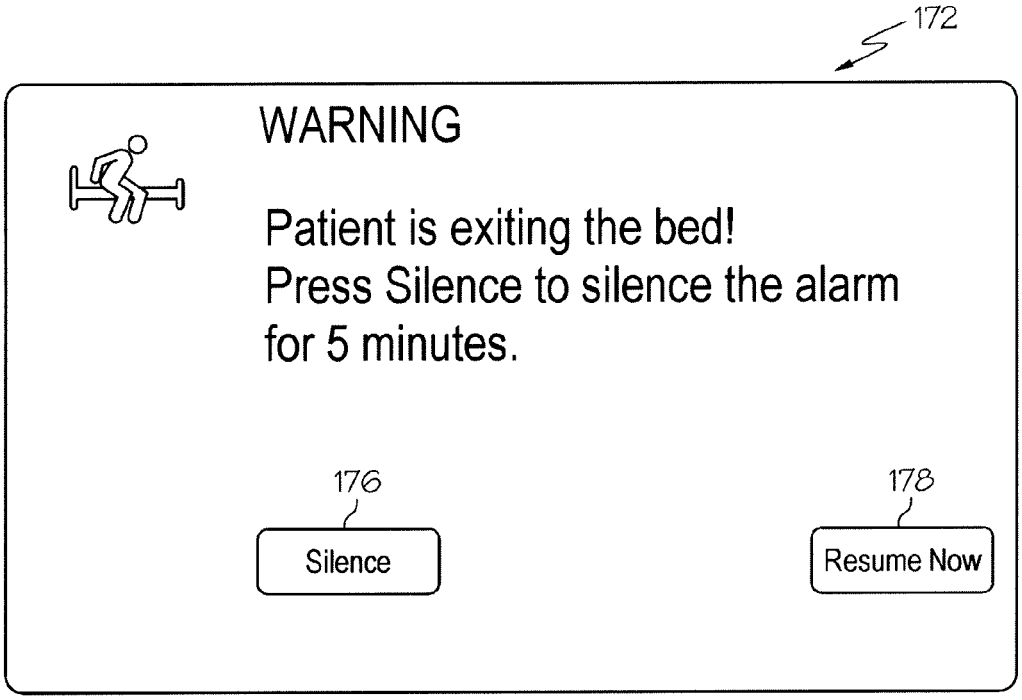
FIG. 7 is a screen shot showing a second alarm screen that appears on the graphical display screen in response to an alarm condition when a bed exit alarm system is enabled or armed in a patient exit mode.
Figure 8:
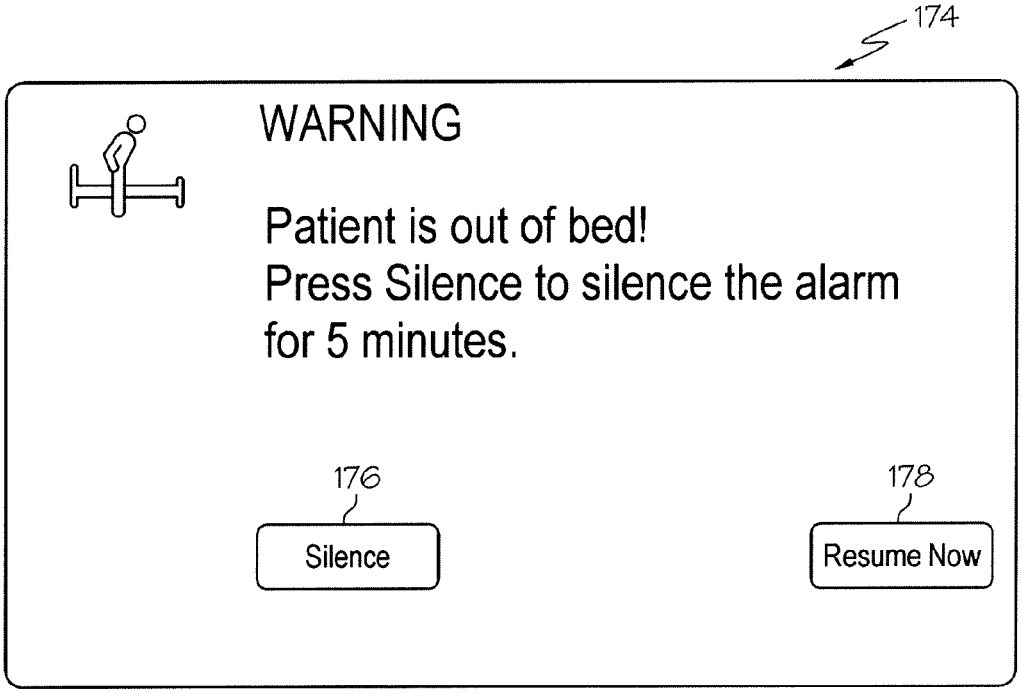
FIG. 8 is a screen shot showing a third alarm screen that appears on the graphical display screen in response to an alarm condition when a bed exit alarm system is enabled or armed in an out-of-bed mode.

The bed exit alarm system of alternative bed 10 also has patient movement, patient exit, and out-of-bed alarm modes which are substantially the same as those described above. When the bed exit alarm system is enabled in the patient movement mode and an alarm condition is detected, a first alarm screen 170 appears on the graphical display screen as shown in FIG. 6 and an audible alarm sounds. When the bed exit alarm system is enabled in the patient exit mode and an alarm condition is detected, a second alarm screen 172 appears on the graphical display screen as shown in FIG. 7 and the audible alarm sounds. When the bed exit alarm system is enabled in the out-of-bed mode and an alarm condition is detected, a third alarm screen 174 appears on the graphical display screen as shown in FIG. 8.

Each of screens 170, 172, 174 has a "Silence" button 176 and a "Resume Now" button 178. While the audible alarm is sounding, button 178 can be pressed on any of screens 170, 172, 174 if the patient is still on the bed or has returned to the bed and is properly positioned. When button 178 is pressed, the bed exit alarm system will re-enable and turn off the audible alarm if the patient is positioned properly so as to meet the original bed exit arming criteria. Under those circumstances, the bed exit alarm system will have been manually re-enabled by pressing button 178. If button 178 is pressed and the patient is not properly positioned on the bed, the audible alarm will simply continue to sound. However, button 176 can be pressed by the caregiver on any of screens 170, 172, 174 to turn off the audible alarm for the silence duration established on screen 150 regardless of the patient's position, including the patient being out of bed altogether. In the illustrative example of FIGS. 6-8, the silence duration is five minutes.

Figure 9:
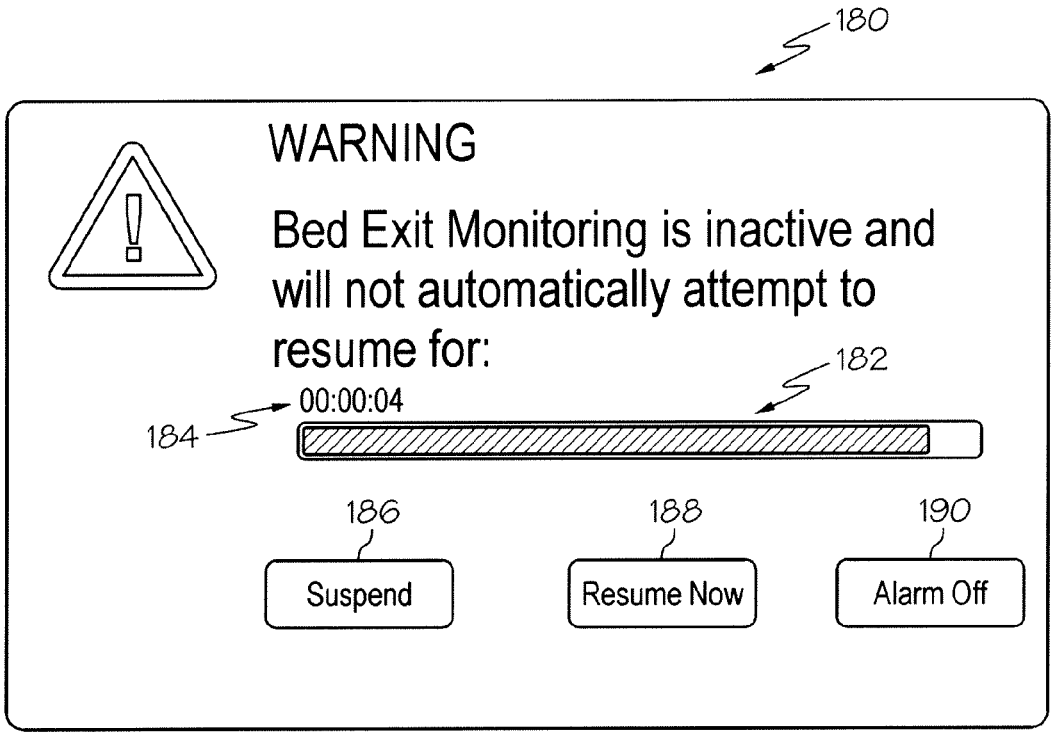
FIG. 9 is a screen shot of a Bed Exit Monitoring Options screen that appears on the graphical display screen if a silence button on any of the screens of FIGS. 6-8 is touched or pressed.

In addition to the audible alarm being silenced when button 176 is pressed, a Bed Exit Monitoring Options screen 180 appears on the graphical display screen as shown in FIG. 9. Screen 180 includes a silence countdown bar 182 which graphically shows the amount of time left in the silence duration. A numerical countdown timer 184 appears above countdown bar 182 to provide a numerical indication of the amount of time left in the silence duration in the illustrative example. At the end of the silence duration, the audible alarm will re-sound if the patient has not returned to the bed in the proper position corresponding to the original mode in which the bed exit alarm system was enabled and the appropriate one of screens 170, 172, 174 will again be shown on the graphical display screen. If the patient has returned to the bed in the proper position, then the bed exit alarm system will automatically be re-enabled at the end of the silence duration without any further action on the part of a caregiver.

Screen 180 also has a "Suspend" button 186, a "Resume Now" button 188, and an "Alarm Off" button 190. At any time during the silence duration, a caregiver can press button 190 to disable the bed exit alarm system altogether or the caregiver can press button 188 which functions in the same manner on screen 180 as button 178 on screens 170, 172, 174. Thus, when button 188 is pressed, the bed exit alarm system will re-enable and turn off the audible alarm if the patient is positioned properly so as to meet the original bed exit arming criteria. Again, under those circumstances, the bed exit alarm system will have been manually re-enabled by pressing button 178. If button 188 is pressed and the patient is not properly positioned on the bed, the audible alarm will simply continue to sound.

At any time during the silence duration, a caregiver can press button 186 to extend the amount of time that the audible alarm is turned off regardless of the patient's position, including the patient being out of bed altogether. In some embodiments, when button 186 is pressed, countdown bar 182 and countdown timer 184 are reset to the suspend duration and begin counting down therefrom. At the end of the suspend duration, the audible alarm will re-sound if the patient has not returned to the bed in the proper position corresponding to the original mode in which the bed exit alarm system was enabled and the appropriate one of screens 170, 172, 174 will again be shown on the graphical display screen. If the patient has returned to the bed in the proper position, then the bed exit alarm system will automatically be re-enabled at the end of the suspend duration without any further action on the part of a caregiver. In some embodiments, the suspend button 186 can be pressed numerous times to reset the countdown bar 182 and countdown timer 184 to the suspend duration assuming the suspend duration has not fully elapsed. In other embodiments, the suspend button 186 can only be pressed once per alarm cycle and a new alarm cycle will occur at the end of the suspend duration, with the alarm sounding and the appropriate one of screens 170, 172, 174 being shown if the patient has not returned to bed in the proper position.

In the above description of FIGS. 6-9, when it is stated that a particular button is "pressed" it is intended to mean that the button is "touched" since the graphical display screen of the alternative bed is a touch screen display. Other manners of selecting buttons or icons on a display screen, such as using stylus or light pen to select an icon or using tab or arrow keys to highlight an icon and then using an enter key, are also intended to be within the scope of this disclosure, as are using hard keys on a key pad adjacent a display screen, and all of these are intended to be equivalents of pressing or touching a button or icon on a graphical display screen. Also, if desired, the alternative embodiment bed discussed above in connection with FIGS. 6-9 also interacts with computer devices 92, 96 via infrastructure 94, such as by sending messages including messages regarding the silenced and suspend modes, in substantially the same manner as described above in connection with the illustrative embodiment of FIGS. 1-4.

Figure 10A:
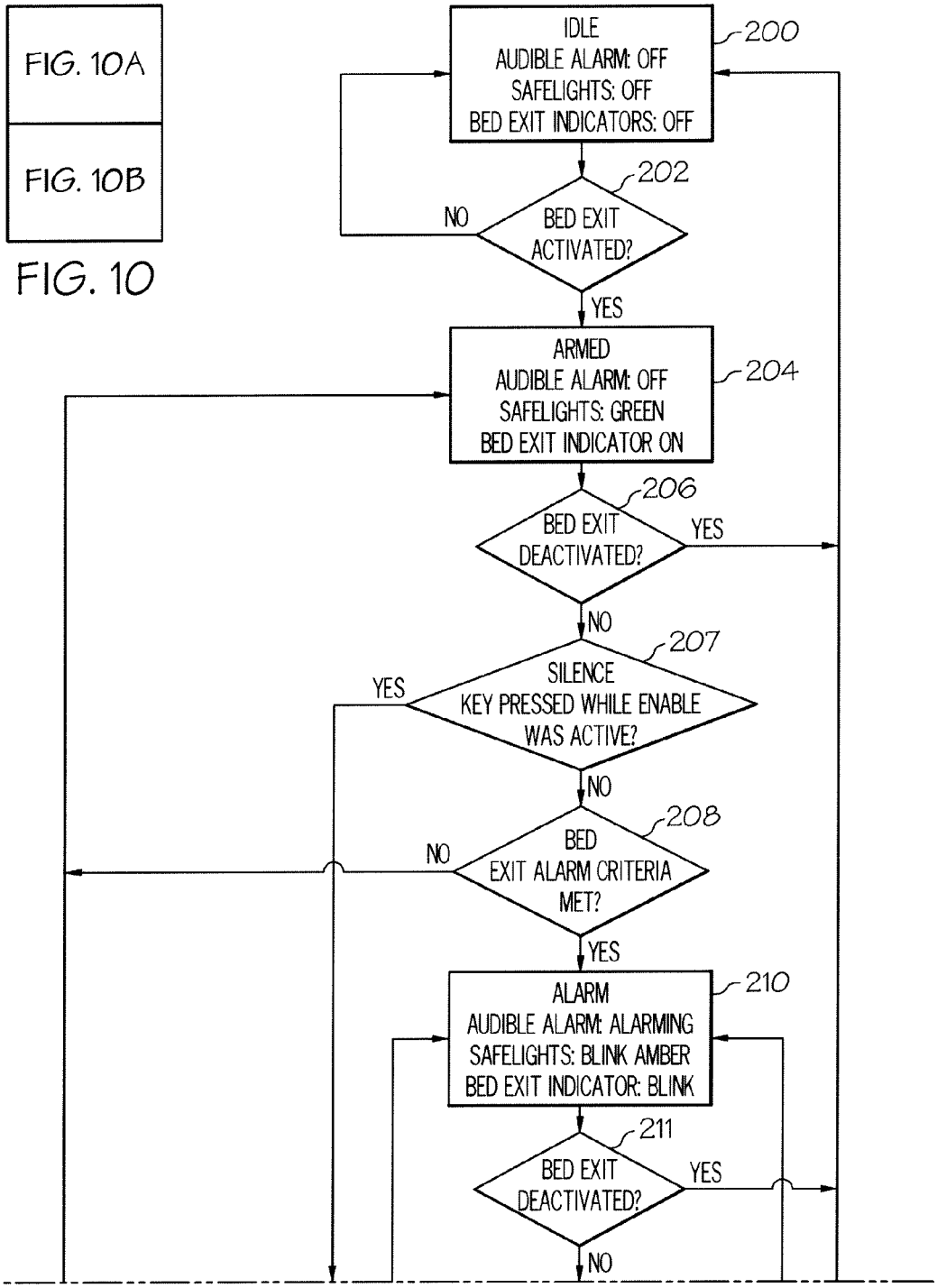
FIG. 10 is a template showing how FIGS. 10A and 10B fit together to form a flow chart of an algorithm that includes steps for preemptively suspending a bed exit alarm from occurring and for automatically re-enabling the bed exit alarm system after the alarm silence button has been used.
Figure 10B:
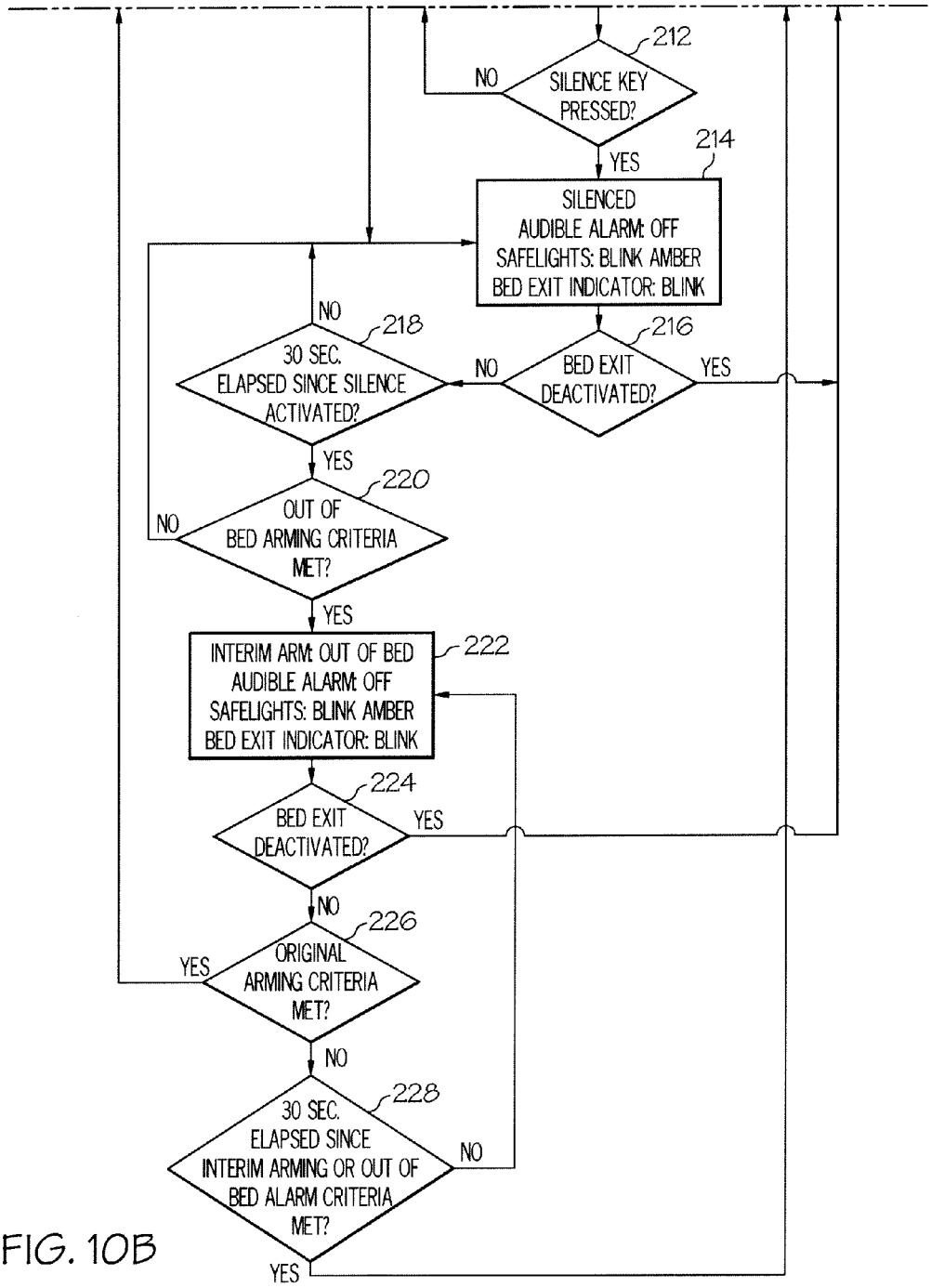

As mentioned previously, in some alternative embodiments, the caregiver first presses enable or key button 66 and then within a threshold amount time presses alarm suspend input 80 while the patient is still on bed 10 in order to preemptively suspend the alarm from occurring when the patient exits the bed shortly thereafter. An algorithm which is illustrative of the software that is stored in circuitry 82 of system 12 of such an alternative embodiment and that implements the auto re-enable feature of such an alternative embodiment is shown in FIGS. 10A and 10B. As indicated at block 200, system 12 has an idle mode in which system 12 is disabled or not enabled. In the idle mode, in which the patient's movement toward exiting the bed 10 is not even monitored, alarms 70, 88 are off as are the LED's 63 that are associated with buttons 60, 62, 64. In FIGS. 10A and 10B the term "safe-lights" is referring to lights 88 and the term "bed exit indicators" is referring to LED's 63 as was the case with regard to the algorithm of FIGS. 3A and 3B. In the algorithm depicted in FIGS. 10A and 10B, the state of alarms 70, 88 is relative only to bed exit alarm system 12. Other conditions of bed 10 being monitored may result in alarms 70, 88 being activated even though a bed exit alarm does not exist.

As indicated at block 202, system 12 checks to determine if it has been enabled in any of its bed exit modes (e.g., the patient movement, patient exit, and out-of-bed modes discussed above). If system 12 has not been enabled, then the algorithm returns to block 200. If system has been enabled, then the algorithm proceeds to block 204 which corresponds to an armed mode in which alarm 70 is off, lights 88 shine green, and the LED 63 corresponding to the mode in which system 12 is enabled is on or lit. When enabling system 12, a caregiver may check to determine that the patient is properly positioned on mattress 30 such as making sure the patient is generally centered between the sides of the bed and, in some embodiment, that the patient's hips are generally aligned with a hip locator such as an indicia on upper frame 28 or on one of siderails 22.

As indicated at block 206, after the system is armed, the algorithm determines whether system 12 has been deactivated or disabled or disarmed. If system 12 has been deactivated, the algorithm returns to block 200. If the system 12 has not been deactivated, algorithm proceeds to block 207 to determine whether the alarm suspend input 88 within a threshold amount of time after enable button 66 was pressed. If keys 66, 80 were pressed to preemptively silence the alarm from occurring, then the algorithm proceeds to block 214 and the algorithm proceeds from block 214 in the manner described below. If keys 66, 80 were not pressed to preemptively silence the alarm from occurring, then system 12 is still enabled, and the algorithm proceeds to block 208. As indicated at block 208, system 12 determines whether bed exit alarm criteria have been met. If the bed exit alarm criteria are not met, then the algorithm returns to block 204 as indicated in FIG. 10A. If the bed exit alarm criteria are met, then system 12 is in an alarm mode and the algorithm proceeds to block 210.

As indicated at block 110, when system 12 is in the alarm mode, audible alarm 70 is activated, lights 88 blink amber, and the LED 63 associated with the mode in which system 12 is enabled blinks. In some embodiments, when an alarm condition is detected, a message such as "bed exit alarm" is displayed on display screen 44 and optionally, the displayed message may flash. While system 12 is alarming in the alarm mode, the algorithm checks to determine if the caregiver has disabled or deactivated system 12 as indicated at block 211. If system 12 has been deactivated, then the algorithm returns to block 200. If system 12 has not been deactivated, the algorithm checks to determine if alarm pause button 80 (referred to as a "silence key" in FIG. 10A) has been pressed as indicated at block 212. If button 80 has not been pressed, then the algorithm returns to block 210 and the alarming continues. If button 80 has been pressed, the algorithm proceeds from block 212 to a silenced or suspend mode as indicated at block 214.

In the silenced or suspend mode of block 214, audible alarm 70 is off, lights 88 continue to blink amber, and the bed exit indicator (i.e., the LED 63 associated with the mode in which the system 12 was enabled) continues to blink. As indicated at block 216 of FIG. 10B, after the algorithm enters the silenced mode, the algorithm determines whether bed exit alarm system 12 has been deactivated via the use of button 66 and the button 60, 62, 64 corresponding to the mode in which system 12 was enabled. If at block 216 it is determined that system 12 has been deactivated, the algorithm returns back to the idle mode of block 200. If at block 216 it is determined that system 12 has not been deactivated, the algorithm proceeds to block 218 to determine whether a threshold amount of time has elapsed, which in the illustrative example, is 30 seconds. If the threshold amount of time has not elapsed, the algorithm returns back to block 214.

If at block 218 it is determined that the threshold amount of time has elapsed, then the algorithm proceeds to block 220 to determine whether the out of bed arming criteria. Thus, at block 220, system 12 is checking to determine whether the patient is in the process of getting back on bed 10 and has gotten onto the bed an amount sufficient to meet the less sensitive criteria of the out-of-bed mode but not the more sensitive criteria of the patient exit mode or patient movement mode. If at block 220 the out of bed arming criteria has not been met, then the algorithm returns to block 214.

If at block 220 the out of bed arming criteria has been met, then system 12 enters into an interim out of bed arming mode as indicated at block 222. In the interim out of bed arming mode, audible alarm 70 continues to be turned off, lights 88 continue to blink amber, and the bed exit indicator (i.e., the LED 63 associated with the mode in which the system 12 was enabled) continues to blink. After entering the interim out of bed arming mode, the algorithm proceeds to block 224 and determines whether the bed exit alarm system has been deactivated altogether by appropriate use of buttons 60, 62, 64, 66 as described above. If system 12 has been deactivated as determined at block 224, the algorithm returns to block 200.

If the system 12 has not been deactivated as determined at block 224, the algorithm continues to determine whether the original arming criteria is met as indicated at block 226. At block 226, therefore, system 12 is checking to determine whether the patient has returned to the bed and the weight of the patient is not distributed in a manner that would violate the original arming criteria corresponding to the selected sensitivity in which system 12 was originally armed. If at block 226 it is determined that the original arming criteria has been met, then system 12 of bed 10 is automatically re-enabled and the algorithm returns to the armed or enabled mode of block 204. A short tone sounds when system 12 is re-enabled or re-armed.

If at block 226 it is determined that the original arming criteria has not been met, then the algorithm of system 12 proceeds to block 228 and determines whether a threshold amount of time, which is 30 seconds in the illustrative embodiment, has elapsed since system 12 entered the interim out of bed arming mode or since system 12 met the out of bed arming criteria. If the threshold amount of time of block 228 has not elapsed, the algorithm returns to block 222 and system 12 remains in the interim out of bed arming mode.

If at block 228 it is determined that the threshold amount of time has elapsed, then the algorithm returns back to block 210 and reactivates or sounds the audible alarm 70 along with continuing to blink lights 88 amber and continuing to blink the bed exit indicators. Thus, in the illustrative example, once system 12 enters the interim out of bed arming mode, the patient has 30 seconds to return to the proper position on bed 12 or else a new alarm will sound.

In the illustrative example, if system 12 enters into the interim out of bed arming mode, the bed exit alarm activation tone does not sound. The tone only sounds when the originally armed mode is re-established in the illustrative example. However, it is within the scope of this disclosure for the bed exit alarm activation tone to sound when system 12 enters into the interim out of bed arming mode. It will be appreciated that, if system 12 was originally enabled or armed in the out-of-bed mode, the algorithm will not proceed to block 228 from block 226 because the original arming criteria is the out-of-bed mode criteria in that instance and the "yes" branch from block 226 will be followed when the out-of-bed mode criteria is met.

As is evident in the algorithm of FIGS. 10A and 10B, when the patient returns to bed 10 when system 12 is in the silenced or suspend mode and the patient returns to a proper position on bed 10, system 12 is enabled or armed without the need for a caregiver to manipulate any of the user inputs of bed 10. This alleviates the problems that may arise due to a caregiver forgetting to re-enable the bed exit alarm system 12 after a patient returns to bed 10.

Although certain illustrative embodiments have been described in detail above, many embodiments, variations and modifications are possible that are still within the scope and spirit of this disclosure as described herein and as defined in the following claims.

The invention claimed is:

1. A hospital bed comprising a patient support structure, a bed exit alarm system carried by the patient support structure, the bed exit alarm system having an audible alarm that sounds when an alert condition is detected by the bed exit alarm system due to an amount of patient movement relative to the patient support structure, the bed exit alarm system includes at least one user input that is used to enable the bed exit alarm system when a patient is supported by the patient support structure, the audible alarm sounding if the bed exit alarm system is enabled and the alert condition is detected, a bed exit alarm silence input, wherein use of the bed exit alarm silence input achieves stopping the audible alarm from sounding and preventing the alarm from sounding depending upon whether the bed exit alarm silence input is used subsequent to or prior to the detection of the alert condition, wherein the bed exit alarm system is configured such that after the bed exit alarm silence input is used, the bed exit alarm system is re-enabled automatically without any action by a caregiver in response to the bed exit alarm system sensing that the patient is, once again, supported on the support structure, and a display screen coupled to the patient support structure, the display screen showing how much time remains before the alarm will sound if no further action is taken by the caregiver while the patient is off of the patient support structure or by the patient to return to being supported by the patient support structure, wherein the display screen is a touchscreen display that is used to selectively program a silence duration and a suspend duration, the silence duration corresponding to a first amount of time the audible alarm is silenced in response to the bed exit alarm silence input being used after the occurrence of the alert condition, the suspend duration corresponding to a second amount of time the audible alarm remains dormant in response to the bed exit alarm silence input being used prior to the occurrence of the alert condition, wherein the first and second amounts of time are programmable to be unequal.

2. The hospital bed of claim 1, wherein the bed exit alarm system includes control circuitry and a plurality of sensors that produce signals from which the control circuitry determines whether the alert condition exists.

3. The hospital bed of claim 2, wherein the plurality of sensors comprise at least one load cell.

4. The hospital bed of claim 2, wherein the plurality of sensors comprise at least one force sensitive resistor.

5. The hospital bed of claim 1, wherein the bed exit alarm silence input comprises a button that is pressed.

6. The hospital bed of claim 5, wherein the button comprises a membrane switch.

7. The hospital bed of claim 5, wherein the patient support structure comprises a barrier and the button is located on the barrier.

8. The hospital bed of claim 7, wherein the barrier comprises one of a siderail and a footboard.

9. The hospital bed of claim 1, further comprising a first light coupled to the patient support structure and wherein the first light blinks after the bed exit alarm silence input is used and prior to the bed exit alarm system being re-enabled automatically.

10. The hospital bed of claim 9, wherein the patient support structure comprises a barrier having a second light and the second light also blinks after the bed exit alarm silence input is used and prior to the bed exit alarm system being re-enabled automatically.

11. The hospital bed of claim 10, wherein the bed exit alarm system can be enabled in a plurality of system modes, each system mode requiring a different amount of movement by the patient relative to the patient support structure before an alarm condition is considered to exist, and wherein the second light that flashes is adjacent to an indicia on the barrier that indicates in which system mode of the plurality of system modes the bed exit alarm system has been enabled.

12. The hospital bed of claim 1, wherein the bed exit alarm system can be enabled in a first system mode in which movement by the patient relative to the patient support structure by a first amount is considered to be the alert condition, wherein the bed exit alarm system can be enabled in an out-of-bed mode in which movement by the patient relative to the patient support structure by a second amount, greater than the first amount, is considered to be the alert condition, and wherein, if the bed exit alarm system was enabled in the first mode prior to the bed exit alarm silence input being used, the bed exit system will first re-enable in the out-of-bed mode as an interim step as the patient enters onto the patient support structure and then will re-enable in the first mode after the patient has more fully moved onto the patient support structure.

13. The hospital bed of claim 12, wherein the bed exit alarm system re-enables in the out-of-bed mode in response to a threshold amount of weight being detected as being added to the patient support structure.

14. The hospital bed of claim 1, wherein the at least one user input can also be used for manually disabling the bed exit alarm system.

15. The hospital bed of claim 14, wherein the at least one user input comprises a key button and a plurality of mode buttons, each of the mode buttons corresponding to a mode of operation of the bed exit alarm system.

16. The hospital bed of claim 15, wherein the bed exit alarm system is configured so that, if the bed exit alarm system is disabled, the bed exit alarm system becomes enabled in response to the key button being pressed and a selected one of the plurality of mode buttons being pressed and wherein the bed exit alarm system is configured so that, if the bed exit alarm system is enabled, the bed exit alarm system becomes disabled in response to the key button being pressed and a selected one of the plurality of mode buttons being pressed.

17. The hospital bed of claim 1, further comprising a power plug coupled to the patient support structure, wherein the bed exit alarm system becomes disabled in response to the power plug being unplugged from a power source regardless of whether the bed exit alert silence input has been used.

18. The hospital bed of claim 1, wherein the bed exit alarm system is configured to sound an arming tone after the bed exit alarm system is re-enabled automatically.

19. The hospital bed of claim 1, wherein after the bed exit alarm silence input is used, a first message is transmitted from the bed to a remote computer device to indicate that the bed exit alarm system is in a suspend mode.

20. The hospital bed of claim 19, wherein after the bed exit alarm system is re-enabled automatically, a second message is transmitted from the bed to the remote computer device to indicate that the bed exit alarm system is no longer in the suspend mode and is re-enabled.

* * * * *